US011149977B2

(12) United States Patent
Li et al.

(10) Patent No.: US 11,149,977 B2
(45) Date of Patent: Oct. 19, 2021

(54) AIR DIFFUSER

(71) Applicant: KAIP Pty Limited, Kingsgrove (AU)

(72) Inventors: Yi Li, Norwood (AU); Sean Badenhorst, Kingsgrove (AU)

(73) Assignee: KAIP Pty Limited, Kingsgrove (AU)

( * ) Notice: Subject to any disclaimer, the term of this patent is extended or adjusted under 35 U.S.C. 154(b) by 463 days.

(21) Appl. No.: 15/764,251

(22) PCT Filed: Sep. 29, 2016

(86) PCT No.: PCT/AU2016/050924
§ 371 (c)(1),
(2) Date: Mar. 28, 2018

(87) PCT Pub. No.: WO2017/054055
PCT Pub. Date: Apr. 6, 2017

(65) Prior Publication Data

US 2018/0283728 A1 Oct. 4, 2018

(30) Foreign Application Priority Data

Sep. 29, 2015 (AU) ..... 2015903966
May 25, 2016 (AU) ..... 2016901983

(51) Int. Cl.
*F24F 13/06* (2006.01)

(52) U.S. Cl.
CPC ..... *F24F 13/06* (2013.01); *F24F 2221/28* (2013.01); *F24F 2221/46* (2013.01)

(58) Field of Classification Search
CPC .... F24F 13/06; F24F 2221/28; F24F 2221/46; F24F 13/08; F24F 13/12;
(Continued)

(56) References Cited

U.S. PATENT DOCUMENTS

2012/0190293 A1* 7/2012 Badenhorst ..... F24F 13/065 454/284
2013/0137359 A1* 5/2013 Badenhorst ..... F24F 13/06 454/333

FOREIGN PATENT DOCUMENTS

AU 2014903568 * 9/2014 ..... F24F 13/06
CN 101619885 A 1/2010
(Continued)

OTHER PUBLICATIONS

Extended European Search Report dated Sep. 12, 2018, issued in corresponding Application No. EP 16 84 9932, filed Sep. 29, 2016, 8 pages.

(Continued)

*Primary Examiner* — Kenneth J Hansen
*Assistant Examiner* — Ryan L Faulkner
(74) *Attorney, Agent, or Firm* — Reichel Stohry Dean LLP; Natalie J. Dean; Mark C. Reichel

(57) ABSTRACT

An air diffuser for supplying air to a space is provided, the diffuser having a central axis, a plurality of discharge elements arranged to guide an air stream towards the space and defining a face of the diffuser and a plurality of channels located about the diffuser central axis, with each channel formed between adjacent pairs of discharge elements. An adjustment mechanism is also provided for adjusting a discharge direction of an air diffuser, as well as methods of forming the air diffusers and adjustment mechanisms hereof.

16 Claims, 32 Drawing Sheets

(58) Field of Classification Search
CPC ..... F24F 2203/1044; F24F 13/10; F24F 7/10; F24F 13/04; F24F 13/062; F24F 13/072
USPC ..... 454/308
See application file for complete search history.

(56) References Cited

FOREIGN PATENT DOCUMENTS

| | | | |
|---|---|---|---|
| CN | 101896692 | A | 11/2010 |
| CN | 104246135 | A | 12/2014 |
| DE | 87 01 001 | U1 | 3/1987 |
| DE | 299 17 484 | U1 | 12/1999 |
| EP | 1 099 914 | A1 | 5/2001 |
| EP | 2322866 | B9 | 2/2014 |
| WO | 2014/014535 | A2 | 1/2014 |

OTHER PUBLICATIONS

Chinese Search Report dated Oct. 12, 2019, issued in corresponding Chinese Application No. 201680069647.7, filed Sep. 29, 2016, 2 pages.
National Intellectual Property Administration, PR China, Search Report for related Chinese Application Serial No. 201680069647.7 filed Sep. 29, 2016, dated Jul. 30, 2020, CN.
International Preliminary Report on Patentability, dated Feb. 20, 2018, issued in corresponding International Application No. PCT/AU2016/050924, filed Sep. 29, 2016, 151 pages.
International Search Report and Written Opinion, dated Feb. 3, 2017, issued in corresponding International Application No. PCT/AU2016/050924, filed Sep. 29, 2016, 13 pages.

* cited by examiner a) b)

VERTICAL, SHORT THROW

VERTICAL, LONG THROW

Perpendicular direction
Long throw a) Section A-A of Fig 32 c)

b) Detail A

AIR DIFFUSER

TECHNICAL FIELD

The present disclosure relates to an air diffuser. Embodiments of the disclosure find particular, but not exclusive, use as a ceiling swirl diffuser and a wall swirl diffuser, as part of an installed air delivery system.

BACKGROUND ART

Buildings can have air conditioning or ventilation systems that distribute air throughout the building through ducts connected to diffusers. The air conditioning systems may operate with variable airflow rate to vary the cooling or heating capacity provided. The diffusers distribute supply air into the spaces to be air conditioned or ventilated. Swirl diffusers can be selected due to the superior levels of draught-free thermal comfort that their high induction discharge characteristics provide. Due to space constraints, such as ceiling grid dimensions into which diffusers may be required to fit, the maximum airflow rate per diffuser may be restricted to a less than optimum value, requiring the added expense of additional diffusers. In variable airflow rate systems the minimum permissible airflow rate of the diffusers, to ensure stable air patterns that do not dump and create draughts, can determine the minimum airflow rate that the air conditioning system may be turned down to, which may be higher than desired. This wastes energy, as it results in higher than required airflow rates under low load conditions thereby wasting fan energy, or if lower airflow rates are nevertheless used then reheat of the supply air is required to prevent dumping, which also wastes energy. Alternatively, if side-blow discharge is used, this tends to be through simple registers, which provide poor mixing, leading to draughts in summer and high level stratification of heat and fresh air in winter, which is inefficient and wastes energy. Side-blow swirl diffusers that address these constraints are expensive and are therefore seldom used.

The above references to the background art do not constitute an admission that the art forms part of the common general knowledge of a person of ordinary skill in the art. The above references are also not intended to limit the application of the diffuser as disclosed herein.

SUMMARY

Disclosed herein is an air diffuser for supplying air to a space. The diffuser has a central axis that can be substantially perpendicular to the diffuser face.

The diffuser may comprise a plurality of discharge elements arranged to guide an air stream towards the space. The plurality of discharge elements have respective edge regions that define a face of the diffuser. A plurality of channels are located about the diffuser central axis. Each channel is formed between adjacent pairs of discharge elements and is configured to guide the air to the space.

In some forms, at least one of the discharge elements may comprise a peripheral portion and a proximal portion relative to the central axis. In at least one form, the peripheral portion may have a first air guide surface positioned at a first acute angle to the diffuser face. In at least one form, the proximal portion may have a second air guide surface positioned at a second acute angle to the diffuser face. The second angle may be different to the first angle.

In some forms, the first acute angle may be less than the second acute angle.

In some forms, the plurality of discharge elements may be substantially radially aligned about the central axis of the diffuser, the central axis being substantially perpendicular to the diffuser face.

In some forms, in use, the first surface may be arranged to guide a peripheral airstream and the second surface may be arranged to guide a proximal air stream. The arrangement of the first and second surfaces may be such that the proximal air stream may be induced by the peripheral air stream to form a combined air stream that may be supplied to the space in a direction that is substantially parallel with the diffuser face.

In some forms, the at least one discharge element may further comprise an intermediate portion located between and integrally formed with the peripheral and proximal portions. The intermediate portion may have a third air guide surface that may be twisted about a substantially radial axis.

In some forms, the intermediate portion may include a geometric twist about the radial axis.

In some forms, the geometric twist may comprise a substantially constant helical pitch such that each point on the third air guide surface traverses a substantially equal helical pitch distance parallel to the central axis for a given angle of rotation about the central axis.

In some forms, each of the discharge elements may be an elongate vane that is evenly spaced from each adjacent elongate vane.

In some forms, each of the elongate vanes may include a geometric twist about the radial axis along a substantial length of the elongate vane.

In some forms, the discharge element peripheral portion may be positioned at a distal end of the elongate vane, and the discharge element proximal portion may be positioned at a proximal end of the elongate vane. The proximal end may be located towards but spaced from the central axis of the diffuser.

In some forms, the proximal end may be connected to a central hub located at the central axis of the diffuser.

In some forms, each channel may be configured to allow the peripheral and proximal airstreams to pass between the adjacent elongate vanes and to the space.

In some forms, each channel may comprise first and second air passages. The first passage may be formed between the peripheral portions of adjacent elongate vanes and may be arranged to guide the peripheral air stream in a first direction substantially in a plane of the diffuser face. The second passage may be formed between the proximal portions of adjacent elongate vanes and may be arranged to guide the proximal air stream in a second direction. The second direction may be different from the first direction.

In some forms, the degree of difference between the first and second directions may be between 5 and 30 degrees. In some forms, the degree of difference between the first and second directions may be between 7 and 15 degrees. In some forms, the difference between the first acute angle and the second acute angle may be between 5 and 30 degrees. In some forms, the difference between the first acute angle and the second acute angle may be between 7 and 15 degrees.

In some forms, the edge regions of the discharge elements may be in the form of a lip. The lip may have a lip surface that is integrally formed with and projects from the peripheral and proximal discharge element portions and may be substantially parallel to the diffuser face.

In some forms, the lip surface may be also integrally formed with and project from the intermediate discharge element portion.

In some forms, the diffuser may further comprise a housing for supporting the plurality of discharge elements. The housing may comprise a plate coplanar with the diffuser face and a neck portion extending from the plate for connecting the diffuser to an air source.

In some forms, the neck may be substantially cylindrical as it extends from the coplanar plate to the air source. In some forms, the neck may flare substantially to the coplanar plate with the diffuser face. In some forms the angle of the flare relative to the coplanar face may be between 25 and 50 degrees. In some forms the angle of the flare relative to the coplanar face may be between 30 and 40 degrees. In some forms, the neck may be substantially cylindrical as it extends from the flare to the air source.

In some forms, each of the plurality of discharge elements may have opposing ends that are fastened to or integrally formed with, respectively, a central portion of the plate and the neck portion of the housing.

In some forms, the central portion of the plate may define the central hub.

In some forms, the diffuser may further comprise an adjustment mechanism. The adjustment mechanism may be able to translate along the central axis and rotate about the central axis between a retracted position, whereby the adjustment mechanism may be positioned towards the air source, and an advanced position, whereby the adjustment mechanism may be positioned away from the air source.

In some forms, when the adjustment mechanism is in the retracted position, the proximal air stream may be induced by the peripheral air stream to form a combined air stream that is supplied to the space in a direction that is substantially parallel with the plane of the diffuser face. In some forms, when the adjustment mechanism is in the advanced position, the adjustment mechanism may interfere with the peripheral air stream such that the combined airstream is supplied in a direction that is substantially perpendicular to the plane of the diffuser face. In some forms, when the adjustment mechanism is between the retracted and engaged positions, the combined air stream may be supplied to the space in a direction that may be somewhere between substantially parallel with the plane of the diffuser face and substantially perpendicular with the plane of the diffuser face.

In some forms, the adjustment mechanism may comprise a guide ring configured to translate and rotate within the neck of the housing.

In some forms, a plurality of slots may be formed in the wall of the guide ring. Each of the slots may be configured to receive a respective discharge element upon translation and rotation of the adjustment mechanism from the retracted position towards the advanced position. Each of the slots may be configured to release its respective discharge element upon translation and rotation of the adjustment mechanism from the engaged position towards the retracted position.

In some forms, the adjustment mechanism may further comprise a plurality of substantially radially aligned guide vanes. Each guide vane may be connected to and may project away from an internal wall of the guide ring.

In some forms, an underside surface of each guide vane may be complementary in shape to the first air guide surface of a respective discharge element first peripheral portion, such that translation and rotation of the adjustment mechanism from the retracted position towards the engaged position causes each guide vane to slide over a respective first air guide surface in use.

In some forms, in use, each guide vane and adjacent peripheral portion of its respective discharge element can together form a diffuser blade.

In some forms, when the adjustment mechanism is in the retracted position, each guide vane may be positioned such that it forms an extension of the peripheral portion of its respective discharge element to thereby increase a guidance width of the diffuser blade.

In some forms, when the adjustment mechanism is in the engaged position, each guide vane may be positioned over the peripheral portion of its respective diffuser element to thereby decrease the guidance width of the diffuser blade.

In some forms, the diffuser may further comprise a collar configured to reduce an effective open area of the diffuser.

In some forms, each discharge element may abut a neck of the diffuser. The neck may be substantially circular about the central axis and may be located upstream of the diffuser face. The diffuser neck may be configured to flare towards the diffuser face.

In some forms, the diffuser may further comprise a first discharging arrangement arranged to discharge a first air stream and a second discharge arrangement arranged to discharge a second airstream. The first discharging arrangement may be configured to adjust a discharge direction of the first air stream. The first airstream may be arranged to induce the second airstream to deliver a combined airstream to the space. Adjustment of the discharge direction of the first air stream in use may be able to control a discharge direction of the combined air stream. The plurality of discharge elements may be substantially radially aligned about the central axis of the diffuser.

In some forms, the second discharging arrangement may be configured to adjust a throw of the second air stream. Adjustment of the throw of the second air stream in use may be able to control a throw of the combined airstream.

In some forms, the discharge elements may be in the form of elongate vanes. Each elongate vane may abut a neck of the diffuser. The neck may be substantially circular about the central axis and may be located upstream of the diffuser face.

In some forms, each elongate vane may have both a respective vane leading edge and a respective vane trailing edge located downstream of the vane leading edge such that the plurality of vane trailing edges lies in the face of the diffuser. This diffuser face may be substantially perpendicular to the diffuser central axis.

In some forms, each channel may be formed within the diffuser neck. Each channel may be configured to guide a portion of the air to the space.

In some forms, each channel may comprise either:

first channels in the first discharging arrangement, each first channel arranged to discharge part of the first airstream from the diffuser face, with the combined airflow of the first airstream parts being eccentric to the diffuser central axis; or second channels in the second discharging arrangement, the second channels configured to discharge the second airstream from the diffuser.

In some forms, at least a portion of the second channels may be located downstream of at least one throttling device.

In some forms, the at least one throttling device may comprise a perforated baffle disposed within a portion of the diffuser neck.

In some forms, the diffuser neck may be substantially cylindrical.

In some forms, the diffuser neck may be configured to flare towards the diffuser face.

In some forms, the diffuser further may comprise a substantially circular hub disposed about the central axis and located at a centre of the diffuser face.

In some forms, the first discharging arrangement may further comprise a discharge direction adjustment mechanism able to translate in parallel to and to rotate about the central axis to in use adjust the discharge direction of the first air stream.

In some forms, the discharge direction adjustment mechanism may comprise a first guide ring segment disposed within the diffuser neck. The first guide ring segment may comprise a plurality of slots formed in a wall of the first guide ring segment. Each of the slots may be configured to release and receive a respective elongate vane upon translation and rotation of the first guide ring segment between a retracted position, whereby the first guide ring segment is located towards an oncoming supply airstream, and an advanced position, whereby the first guide ring segment is located away from the oncoming airstream.

In some forms, the wall of the first guide ring segment corresponds substantially to a cylindrical wall that is truncated.

In some forms, a trailing edge of the first guide ring segment may translate within at least a portion of the flare in the diffuser neck.

In some forms, the discharge direction adjustment mechanism may comprise a plurality of substantially radially aligned first guide vanes. A surface of each first guide vane may be complementary in shape to an air guide surface of a respective elongate vane. In use, each first guide vane and elongate vane may be able to combine together to form a first diffuser blade such that translation and rotation of the discharge direction adjustment mechanism between the advanced position and the retracted position causes each first guide vane to slide over a respective elongate vane, thereby reducing or extending a chord of the first diffuser blade and thereby a depth of the first channel.

In some forms, each first guide vane may be connected to and may project away from the wall of the first guide ring segment.

In some forms, when the discharge direction adjustment mechanism is in the retracted position, the first airstream may be discharged in a first direction. In some forms, when the discharge direction adjustment mechanism is in the advanced position, the first airstream may be discharged in a second direction.

In some forms, the first direction may be of a greater angle of inclination relative to the central axis than the second direction.

In some forms, the second discharging arrangement may further comprise a throw adjustment mechanism able to translate parallel to and rotate about the central axis and configured to adjust the throw of the second air stream.

In some forms, the throw adjustment mechanism may comprise a second guide ring segment located within the diffuser neck, The throw adjustment mechanism may comprise a plurality of slots formed in a wall of the second guide ring segment. Each of the slots may be configured to receive and release a respective elongate vane upon translation and rotation of the second guide ring segment between a retracted position located towards an oncoming supply airstream, and an advanced position located away from the oncoming air stream.

In some forms, the wall of the second guide ring segment may correspond substantially to a cylindrical wall that is truncated.

In some forms, a trailing edge of the second guide ring segment may translate within at least a portion of the flare in the diffuser neck.

In some forms, the throw control mechanism may comprise a plurality of substantially radially aligned second guide vanes. A surface of each second guide vane may be complementary in shape to an air guide surface of a respective elongate vane. In use, each second guide vane and elongate vane may be able to combine together to form a second diffuser blade such that translation and rotation of the discharge direction adjustment mechanism between the advanced position and the retracted position causes each second guide vane to slide over a respective elongate vane, thereby reducing or extending a chord of the second diffuser blade and a depth of the second channel.

In some forms, each second guide vane may be connected to and may project away from the wall of the second guide ring segment.

In some forms, when the throw control mechanism is in the retracted position, the second airstream may be discharged in a first pattern, and when the throw control mechanism is in the advanced position, the second airstream may be discharged in a second pattern.

In some forms, the first pattern may be of shorter throw relative to the diffuser face than the second pattern.

In some forms, the first and second guide ring segments may be configured to translate independently of one another and may together form a complete ring.

In some forms, a circumferential length of the second guide ring segment may be greater than a circumferential length of the first guide ring segment.

In some forms, the first and second guide ring segments may be configured to translate independently of one another and may each form a complete ring.

In some forms, the first ring segment may be concentrically located within the second guide ring segment. An advantage of this embodiment is that the discharge direction air stream may be less eccentric to the diffuser central axis and hence less offset from the centre-line of the throw adjustment airstream. It may, therefore, be better able to induce the throw adjustment air stream to alter the discharge direction of the combined airstream.

Also disclosed herein is an adjustment mechanism for adjusting a discharge direction of an air diffuser. The adjustment mechanism may comprise a guide ring configured to translate and rotate relative to the diffuser. The adjustment mechanism may comprise a plurality of substantially radially aligned guide vanes. Each guide vane may be connected to and may project away from an internal wall of the guide ring.

Also disclosed herein is a discharge direction adjustment mechanism for adjusting a discharge direction of an at least one first air stream discharged by the air diffuser. The discharge direction adjustment mechanism may comprise a first guide ring segment configured to translate and rotate relative to the diffuser. The adjustment mechanism may comprise a plurality of substantially radially aligned guide vanes. Each guide vane may be connected to and may project away from a wall of the guide ring.

In some forms the wall of the first guide ring segment may be substantially in the form of a truncated cylinder.

In some forms, the adjustment mechanism may be manually adjustable. In some forms, the adjustment mechanism may be adjusted by means of a thermally operated actuator that expands and retracts based on the air source temperature. In some forms, the adjustment mechanism may be adjusted by means of an electric actuator in response to an electrical control input or a pneumatic actuator in response to a pneumatic input.

In some forms, a plurality of slots may be formed in the wall of the guide ring. Each of the slots being may be configured to receive a respective discharge element of the diffuser upon translation and rotation of the adjustment mechanism from a retracted position towards an advanced position. Each of the slots may release its respective discharge element upon translation and rotation of the adjustment mechanism from the engaged position towards the retracted position.

In some forms, at least one of the plurality of the guide vanes may include a geometric twist about a substantially radial axis of the guide ring.

In some forms, the geometric twist may comprise a substantially constant helical pitch such that each point on the guide vane traverses an equal helical pitch distance parallel to a central axis of the guide ring for a given angle of rotation about the central axis.

Also disclosed herein is a method of manufacturing an air diffuser. The method may comprise cutting a flat metal sheet to form a plurality of discharge blades. The method may also comprise pressing the metal sheet to form a geometric twist in the discharge blades.

In some forms, the geometric twist may comprise a substantially constant helical pitch such that each point on the discharge blade traverses an equal helical pitch distance parallel to a central axis of the diffuser for a given angle of rotation about the central axis.

In some forms, the method may further comprise trimming the discharge blades to reduce a width of the discharge blades.

In some forms, the method may further comprise forming a curved bell-mouth and a neck portion by stamping, pressing or rolling a metal strip, such that the metal sheet is curved about a central axis and a portion thereof is flared relative to the central axis. In some forms, the method may further comprise wrapping the bell-mouth and neck portion around the diffuser blades.

In some forms, the metal sheet may have a plurality of slots formed therein. Each slot may be configured to receive a tag of a respective diffuser blade upon wrapping the neck portion around the diffuser blades. In some forms, the method may further comprise riveting the neck portion of the metal sheet to the diffuser elements. Advantageously, the tags and their interaction with the slots of the neck portion can serve a dual purpose in that the tags are able hold the bell-mouth in place and ensure the angle of diffuser blades remains constant during manufacture.

In some forms, the bell-mouth may comprise a flange portion.

In some forms, the method may further comprise welding the flange portion to the metal plate.

Also disclosed herein is an air diffuser for supplying air to a space. The diffuser has a central axis. The diffuser may comprise a plurality of discharge elements arranged to guide an air stream towards the space. The plurality of discharge elements may have respective edge regions that define a face of the diffuser. At least one of the discharge elements may comprise a peripheral portion and a proximal portion relative to the central axis. In at least one embodiment, the peripheral portion, may have a first air guide surface arranged to guide a peripheral air stream in a first direction that is substantially perpendicular to the diffuser face. The proximal portion may have a second air guide surface arranged to guide a proximal air stream in a second direction. The first and second directions may form an acute angle therebetween. The diffuser may be as otherwise described above.

In some forms, the diffuser may include a throttling device upstream of at least a portion of the channels. In some forms, the throttling device may be a perforated baffle.

Also disclosed herein is an air diffuser for supplying air to a space. The diffuser has a central axis. The diffuser may comprise a plurality of discharge elements that are substantially radially aligned about the central axis of the diffuser and arranged to guide an air stream towards the space. The plurality of discharge elements may have respective edge regions that define a face of the diffuser. The central axis may be substantially perpendicular to the diffuser face. A plurality of channels may be located about the diffuser central axis. Each channel may be formed between adjacent pairs of discharge elements and may be configured to guide the air to the space. Each discharge element may have a proximal end that is connected to a central hub located at the central axis of the diffuser.

In accordance with the disclosure, the central hub may be in the form of a perforated central hub. The perforated central hub may comprise a plurality of apertures formed therethrough. Each aperture may be configured to discharge a portion of the supply air stream to the space.

BRIEF DESCRIPTION OF THE DRAWINGS

Embodiments will now be described by way of example only, with reference to the accompanying drawings in which

FIG. 29*a-b* show side section views of an embodiment of the ceiling swirl diffuser;

DETAILED DESCRIPTION OF SPECIFIC EMBODIMENTS

Figure 1:
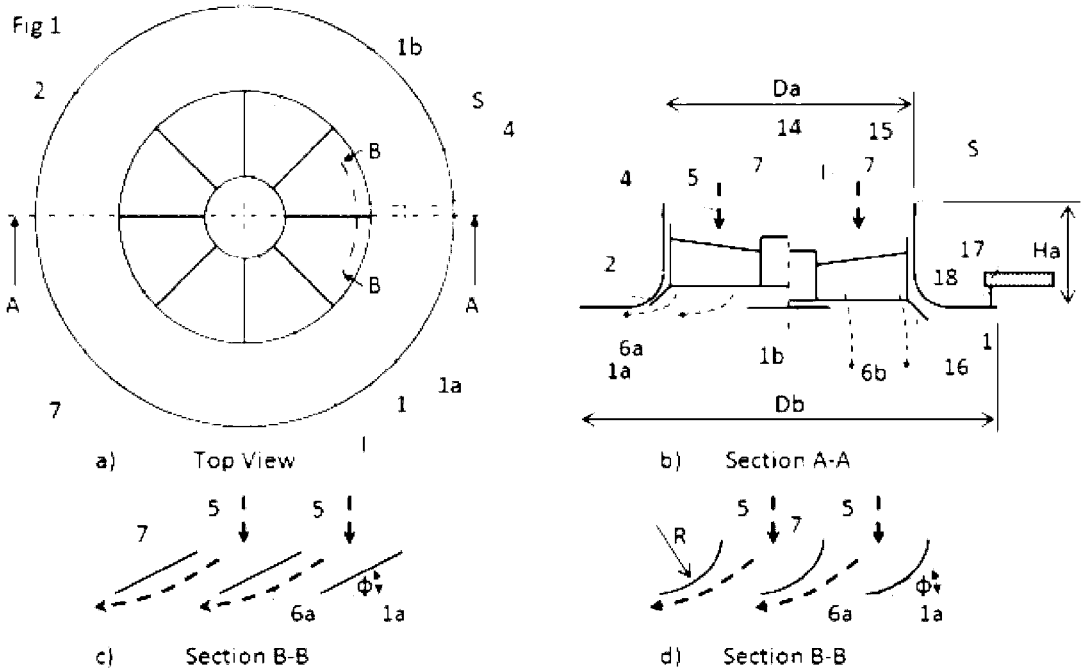
FIGS. 1*a* and 1*b* are diagrams illustrating a ceiling swirl diffuser of the prior art.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

By way of introducing embodiments of the present disclosure, aspects relating to diffusers are firstly mentioned. Ceiling diffusers in buildings are usually designed to discharge air horizontally above head height, with a throw that substantially covers the footprint of the space to be dealt with by each diffuser, as reduced throw (i.e. under-throw) increases the threat of dumping in cooling mode, thereby creating draughts and poor temperature distribution in the occupancy space. Conversely, increased throw (i.e. over-throw) increases the threat of air streams clashing with one another or with obstructions, such as walls, thereby increasing the threat of draughts.

In spaces requiring heating from ceiling diffusers, especially if ceilings are high, diffusers with a substantially downward discharge direction are often selected so as to compensate for the buoyancy of the hot supply air, thereby improving the penetration of warm supply air into the low level occupancy zone.

Ceiling swirl diffusers are increasingly being used in preference to four-way blow diffusers or other low induction air diffusion equipment for both of the aforementioned applications, as their highly inductive discharge draws in and mixes large quantities of room air into the discharged supply air stream, thereby rapidly breaking down the supply-to-room temperature differential to provide more uniform temperature distribution throughout the occupancy space whilst simultaneously bringing about rapid discharge velocity decay, which enhances draught-free comfort.

In order to reduce fan energy during off-peak loads, variable speed supply air fans or variable air volume (VAV) supply air systems are often used to supply conditioned air to the diffusers, especially in cooling mode. Such systems, though, are often not used at reduced airflow rates in heating mode, especially for supply air discharge from high ceilings, as reduced discharge velocity from each diffuser reduces the momentum of the warm and buoyant supply air being discharged down into the occupancy space, thereby reducing supply air penetration to the occupants, impairing heating effectiveness and efficiency.

To deal with variable air flow rates in cooling mode the diffusers need to provide stable horizontal discharge with relatively constant horizontal throws of the low temperature supply air, at both high and low airflow rates. For diffusers that have fixed horizontal discharge, high airflow rates generally increase throw, often producing over-throw, which may cause draughts where air streams from adjacent diffusers clash or where air streams hit obstructions such as walls or bulkheads. In contrast, low airflow rates reduce throw, often causing zones of stagnation and of increased air temperature beyond the throw of the diffuser whilst cold spots or even draughts may occur close to or beneath each diffuser due to dumping of cold, dense supply air into the occupancy space. In such variable air volume applications standard horizontal discharge ceiling swirl diffusers with fixed horizontal discharge perform substantially better, both in terms of efficiency and perceived comfort, than horizontal discharge four-way blow diffusers, due to the higher induction ratios and better mixing of supply and room air provided by the former, but even so, a turndown ratio to approximately 30 to 40 percent of the maximum airflow rate is usually the lower limit of the former in cooling mode, especially if the supply-to-room temperature differential is high (often as high as −16 K); and heating effectiveness of the former is only slightly improved due to increased mixing, but it is nevertheless poor due to the horizontal discharge direction of such standard horizontal discharge swirl diffusers.

Adjustable dampers, arranged to maintain a substantially constant supply air stream velocity onto a portion of the swirl vanes, are sometimes used directly upstream of the diffuser so as to decrease the minimum permissible diffuser airflow rate. Such dampers are often motorised for VAV applications, and hence extend the VAV range of the diffuser, however they typically blank off a portion of the swirl blades even at the maximum airflow setting, thereby necessitating the need for oversized diffusers, and they tend to generate noise due to the increased air stream velocity onto the active portion of the swirl blades. They are, moreover, complex and costly.

Swirl diffusers with adjustable discharge direction (usually achieved by altering the diffuser blade angle, or by adjustable guide vanes or jets of air that may be activated to deflect or induce the supply air stream downwards) are often used to improve heating efficiency by directing the warm supply air downwards. Such diffusers often incorporate thermally powered or electric or pneumatic actuators that automatically adjust discharge direction as a function of the supply air temperature or the supply-to-room air temperature differential. Adjustable blade angle tends to offer excellent heat penetration to a low level, but cooling performance is compromised due to the extremely flat blade angle required to discharge air horizontally, as this, in turn, restricts the aperture between diffuser blades. Indeed, relatively flat blade angles are required for all of the swirl diffusers of the prior art in cooling mode; they, therefore, have to be selected with relatively large diffuser face sizes in relation to the airflow rate to be discharged, negatively impacting space requirements, costs and aesthetics.

The embodiments, as described herein, relate generally to an air diffuser assembly for ceiling discharge with an air supply supplied from a pressure plenum or duct. FIG. 1*a* is a diagram illustrating the top view of a ceiling swirl diffuser with adjustable discharge direction of the prior art (S), with a central hub 1*b*, a bell-mouth 2 and a face 1 in face plane 1*a*, which is perpendicular to central axis (I). Eight substantially radially aligned vanes 7 about central axis (I) are visible between the hub 1*b* and bell-mouth 2.

FIG. 1*b* is a diagram illustrating a side section view of the ceiling swirl diffuser of the prior art (S) shown in FIG. 1*a*, in which supply airstream 5 flows into the neck 4 of diffuser (S) and onto substantially radially aligned swirl vanes 7 about central axis (I) to be discharged from face 1 as a swirling air stream directed substantially parallel 6*a* or substantially perpendicular 6*b* to face plane 1*a*. Face 1 and central hub 1*b* both lie substantially on face plane 1*a* and are thus substantially level with one another. The diffuser (S) may either be freely suspended in the space, as shown on the left of FIG. 1*b*, or may be mounted in a closed ceiling 17 that is substantially parallel to face plane 1*a*, in which case spacer 18 is typically required to ensure that face 1 is located well proud of the underside of ceiling 17, as shown on the right of FIG. 1*b*.

The diffuser (S) incorporates discharge direction assembly 14 comprising a cylinder 15 with flared mouth 16 and swirl vanes 7 fixed to cylinder 15. An adjustment mechanism (not shown) that typically includes an electrical actuator raises or lowers (as shown in the left and right of FIG. 1*b*, respectively) the location of the discharge direction assembly 14 to generate swirling supply air discharge that is substantially parallel 6*a* or perpendicular 6*b* to face plane 1*a*, respectively. When the discharge direction assembly 14 is raised, as shown in the left of FIG. 1*b*, the trailing edge of flared mouth 16 is recessed relative to the plane of central hub 1*b* to abut bellmouth 2, which connects neck 4 to face 1, thereby allowing Coanda effect attachment of the swirling discharged airstream to face 1, resulting in swirling supply air discharge that is substantially parallel 6*a* to face plane 1*a*. When the discharge direction assembly 14 is lowered, as shown in the right of FIG. 1*b*, the trailing edge of flared mouth 16 protrudes below face plane 1*a* and hence beyond central hub 1*b* and bellmouth 2, thereby disrupting Coanda effect attachment of the swirling discharged airstream to face 1 whilst creating a negative air pressure zone directly beneath central hub 1*b*, resulting in swirling supply air discharge that is detached from face 1 to be discharged substantially perpendicular 6*b* to face plane 1*a*. In this latter case the pressure drop of the diffuser is increased due to the decreased open area at the discharge face.

The number of substantially radially aligned vanes 7 is small (typically between eight and twelve) as a high number causes excessive Coanda effect attachment to face 1, thereby preventing stable discharge direction adjustment from parallel to perpendicular to face plane 1 unless the vane angle is increased relative to face plane 1*a*, in which case stable airflow parallel to face plane 1*a*, especially when discharging low supply airflow rates of cold air, is compromised. As a result, large gaps exist between vanes 7, which are unsightly. This may be overcome by additional or alternative discharge direction adjustment components (not shown), such as ones that open the annular passage between cylinder 15 and neck 4 when the direction adjustment assembly 14 is lowered (in which case flared mouth 16 and central hub 1*a* are typically absent) so as to discharge a high velocity annular jet of air without swirl perpendicular to face plane 1*a* which diverts the discharged swirling air stream from substantially parallel to substantially perpendicular to face plane 1*a*. Such design components add complexity and cost, and require a significant pressure drop across the air path through vanes 7 to generate sufficient static pressure to discharge a high velocity annular jet of air through the annular passage between cylinder 15 and neck 4, adding the penalty of increased fan energy, especially when the annular jet of air is throttled to alter discharge direction to substantially parallel to face plane 1*a*.

In applications where the diffuser is mounted in a closed ceiling, diffuser face 1 must be located well proud of the underside of the ceiling 17, typically by inserting spacer 18 (which may, alternatively, form an integral part of the outer edge of face 1) so as to ensure that the additional Coanda effect attachment of substantially parallel projecting swirling air stream 6*a* to the ceiling 17 is not too strong to prevent stable discharge direction adjustment to substantially perpendicular 6*b*).

Key components of the discharge direction assembly 14 are either recessed (eg the vanes 7 as shown in the left of FIG. 1*b* or protrude (eg the flared mouth 16) as shown in the right of FIG. 1*b* relative to face plane 1*b*. The diffuser, therefore, does not have a substantially flush face. This, plus the fact that face 1 may typically not be substantially flush mounted to a closed ceiling, is problematic for applications where substantially flush visible surfaces are the preferred architectural aesthetic.

In order to achieve stable Coanda effect attachment that produces substantially horizontal swirling discharge 6*a* in applications in which face 1 is freely suspended as shown in the left of FIG. 1*b* (ie not mounted in close proximity to a closed ceiling) the face diameter (Db) typically needs to be approximately 1.5 times (or more) the neck diameter (Da), which causes the diffuser (S) to be extremely bulky, bringing about the disadvantages of both a dominant aesthetic in the space, which architects are generally averse to, as well as added transport and storage expenses for the product prior to installation. The bulk of the diffuser (S) is further exacerbated by diffuser height (Ha) which typically is equal to approximately 0.5 (or more) times the neck diameter (Da).

FIGS. 1*c* and 1*d* are diagrams illustrating that the substantially radial vanes 7 may have a cross section that is flat or curved (radius R) to achieve a discharge angle (φ) relative to face plane 1*a* that allows for substantially parallel swirl airflow discharge 6*a* to face plane 1*a* when direction adjustment assembly 14 is raised. The vane angle (φ) and vane radius (R) are typically constant across the length of vane 7.

It will be apparent to a person skilled in the art that many different designs exist of swirl diffusers with adjustable discharge direction. The above is given as an example, only, of one such design of the prior art. It illustrates the typical constraints associated with the prior art, viz excessive bulk (height and/or diameter), non-flush face, large gaps between vanes, the need to be located proud of a closed ceiling, high pressure drop, varying pressure drop between parallel and perpendicular discharge patterns, mechanical complexity, etc. Depending on the prior art design, these constraints may occur individually or in various combinations with one another. The disclosure disclosed herein overcomes these constraints and the limitations that they impose.

Referring now to FIGS. 2*a-d*, an air diffuser according to the present disclosure is shown. The air diffuser is shown in the form of a ceiling swirl diffuser 1 and is arranged to supply air to a space (e.g. office, warehouse, hospital, domestic building etc). FIG. 2*a* is a diagram illustrating the top view of a ceiling swirl diffuser 1 with fixed discharge direction in accordance with the disclosure, with a central hub 1*b* and a face 1*a*. The ceiling swirl diffuser 1 comprises a plurality of discharge elements, in the form of fixed vanes 7, arranged to guide an air stream (6*a*, 6*b*) towards the space. In the detailed embodiments, sixteen substantially radially aligned fixed vanes 7 are visible between the hub 1*b* and face 1*a*. The number of vanes 7 shown is illustrative only, to indicate that the diffuser is well suited to a high number of vanes relative to the prior art depicted in FIG. 1. Higher fixed vane numbers reduce the size of the unsightly gaps between vanes. In the illustrated form, the plurality of fixed vanes have an identical shape, as will be described below. However, as will be evident to the person skilled in the art, other arrangements may be possible, whereby some, but not all, fixed vanes share a common shape.

The respective edge regions 7*a* of the fixed vanes together define a face of the diffuser face 1*a* (i.e. the edges 7*a* of the vanes lie in a plane substantially flush with the diffuser face). In the detailed embodiments, the diffuser face 1*a* faces the space into which air is supplied by the diffuser. The fixed vanes 7 comprise a peripheral portion 9 and a proximal portion 11 relative to the central axis of the diffuser. The first peripheral portion 9 has a first air guide surface 9*a* that is positioned such that it defines a first acute angle (see α in FIG. 2*c*) with the diffuser face 1*a*. The second proximal portion 11 of the fixed vane 7 has a second air guide surface 11*a* positioned at a second acute angle (see β in FIG. 2*d*) to the diffuser face, the second angle being different to the first surface 9*a* (e.g. the surfaces are offset from one another). The angle between the first and second air guide surfaces equals β−α. The plurality of fixed vanes 7 are substantially radially aligned about a central axis (I) of the diffuser 1, the central axis (I) being substantially perpendicular to the diffuser face 1*a*.

The supply air stream includes a proximal airstream 6*d* that is induced by peripheral airstream 6*a* to form a combined air stream that has a discharge pattern that is substantially parallel to face plane 1*a* and that has an airflow rate that is greater than that which would have been possible from a diffuser of the prior art with fixed vanes 7 that have a fixed vane angle or curvature.

The fixed vanes 7 further comprise an intermediate portion 19 located between and integrally formed with the peripheral 9 and proximal 11 portions of the fixed vanes 7. Intermediate portion 19 of the fixed vanes 7 has a third air guide surface 19*a* that is twisted about a radial axis (X). As shown in FIG. 2*b*, the radial axis (X) is substantially perpendicular to the central axis (I).

The intermediate portion 19 of the fixed vanes 7 incorporates a range of geometric twist. Intermediate portion 19 traverses a substantially helical path of fixed helical pitch about central axis (I), which is perpendicular to face plane 1*a*. As will be evident to the skilled addressee, alternative embodiments of the diffuser may not include a geometric twist. The geometric twist of the intermediate portion 19 is further described with reference to FIG. 3.

FIG. 2*b* is a diagram illustrating a side section view of the ceiling swirl diffuser 1 shown in FIG. 2*a*, in which supply air stream 5 flows into the neck 4 of diffuser 1 and onto the substantially radially aligned fixed swirl vanes 7 to be discharged from face 1*a* as a swirling air stream directed substantially parallel 6*a*, 6*b* to the diffuser face 1*a*. The fixed vane trailing edges 7*a* and central hub 1*b* lie substantially on the diffuser face 1*a* and are thus substantially level with one another, creating a substantially flush diffuser visible surface, which is aesthetically beneficial. The diffuser 1 may either be freely suspended in the space, as shown in the left of FIG. 2*b*, or may be mounted substantially flush with the underside of a closed ceiling 17, which is substantially parallel to the diffuser face 1*a*, as shown in the right of FIG. 2*b*.

The intermediate portion 19 of geometric twist is shown located towards the periphery (i.e. away from the central axis I) of the substantially radial vanes 7 so as to allow for a shallow vane angle adjacent to bellmouth 2 to facilitate airflow attachment of discharged combined swirling airstream 6*a*, 6*b* to the diffuser face 1*a*, and to allow for an increasing vane angle relative to diffuser face 1*a* closer to central axis I, thereby increasing the amount of air that may be discharged by the diffuser 1.

Figure 2:
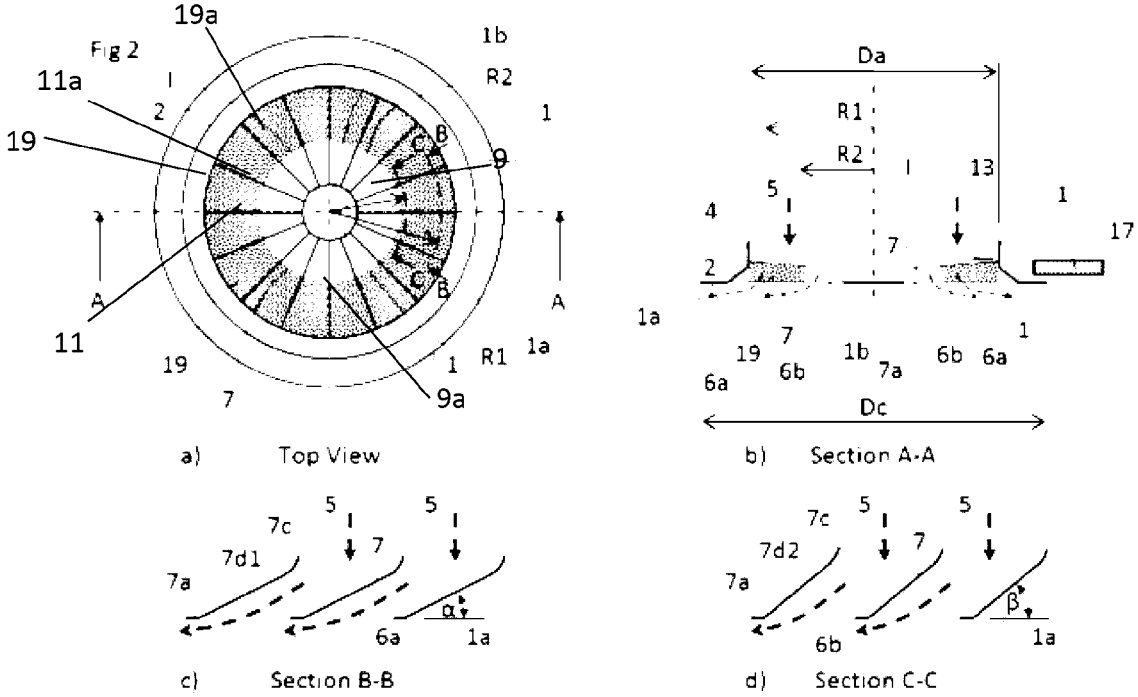
FIGS. 2*a* to 2*d* are diagrams illustrating a ceiling swirl diffuser with fixed discharge direction in accordance with the disclosure.

Due to the portion of geometric twist 19, for a given neck diameter (Da) and airflow rate of supply airstream 5, the face diameter (Dc) of the diffuser 1 in accordance with the disclosure may be smaller than the face diameter (Db) of the diffuser of the prior art depicted in FIG. 1, without compromising stable horizontal discharge patterns 6*a*, 6*b* even in freely suspended applications, especially when discharging low airflow rates of cold air. This allows for a more compact design, reducing the aesthetic impact of diffuser 1 in the space and reducing transport and storage costs of the diffuser.

Due to the portion of geometric twist 19, for a given neck diameter (Da) and airflow rate of supply airstream 5, the pressure drop of the diffuser 1 in accordance with the disclosure may be smaller than that of a diffuser of the prior art with constant vane angle or vane radius across the length of vane 7, without compromising stable horizontal discharge patterns 6*a* even in freely suspended applications, especially when discharging low airflow rates of cold air. This saves fan energy or allows larger airflow rates to be discharged at the same pressure drop produced by diffusers of the prior art.

FIG. 2*b* further shows that the inside of diffuser neck 4 may be fully open, as shown on the left, or may optionally be throttled by a collar 13, as shown on the right. Optional collar 13 may be available in a variety of sizes to reduce the effective open area of neck 4, achieving discharge substantially parallel to diffuser face 1*a* of relatively reduced airflow rate, and may be in the form of a 360° band about central axis (I) located adjacent to neck 4 to produce a 360° discharge pattern of the reduced airflow rate 6*c*, and/or it may be in the form of one or more sectors (eg a 90° collar sector that blocks a quarter sector of neck 4 to reduce the discharge pattern of reduced airflow rate from 360° to 270° about central axis (I)). Such optional collars 13 allow diffusers of the same size and face pattern to be used for a variety of differing airflow rates and differing airflow patterns in a plane substantially parallel with diffuser face 1*a*, thereby providing architects with a substantially uniform diffuser aesthetic for a broadened range of applications, which is generally preferred.

FIGS. 2*c* and 2*d* are section views taken at radii R1 and R2 (FIG. 2*a-b*) from central axis (I), respectively, illustrating that each vane 7 within the portion of geometric twist 19 has a vane body of varying pitch (7*d*1 and 7*d*2) with vane angle β depicted greater than vane angle α, thereby illustrating that the vane angle relative to the diffuser face increases with decreasing radius from central axis (I). This is further described in FIG. 3.

FIGS. 2*c* and 2*d* further illustrate that each vane 7 may include an edge region, in the form of trailing lip edge 7*a*, that lies substantially on diffuser face 1*a* and may also include a cambered leading edge π that arcs into oncoming supply air stream 5. The vane trailing edges 7*a* are dimensioned to discharge the swirling air stream 6*a* substantially parallel to diffuser face 1*a*. The cambered leading edges π reduce pressure drop and noise. In the detailed embodiment, the trailing edge 7*a* has a trailing edge surface that is integrally formed with and projects from the peripheral 9, proximal 11 and intermediate 19 discharge element portions, the trailing edge surface being configured to induce a swirling effect on the discharged peripheral 6*a* and proximal 6*b* air streams.

Figure 3:
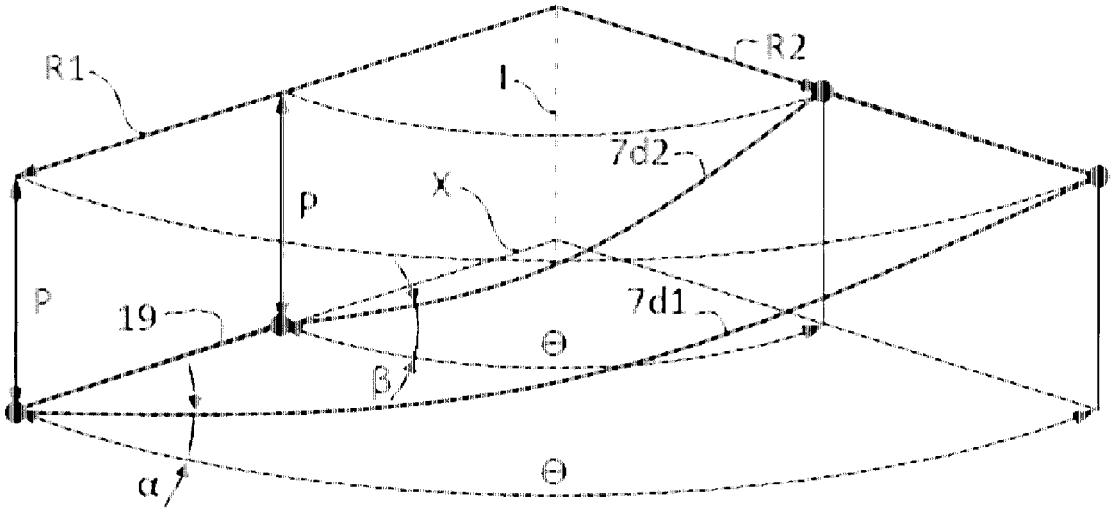
FIG. 3 is a diagram illustrating helical blade geometric twist of a swirl diffuser in accordance with the disclosure.

FIG. 3 is a diagram illustrating that within the portion of geometric twist 19 of each vane 7, the change in vane angle (β−α) along a substantially radial axis (X) from and perpendicular to central axis (I) is defined by any two points at differing radii (R1 and R2) from central axis (I) with each point traversing along vane 7 a pitch of differing vane angle (α and β, respectively, relative to a plane perpendicular to central axis (I) that follows a substantially helical path (7*d*1 and 7*d*2, respectively) through equal angles of rotation Θ about central axis (I), such that each point traverses an equal helical pitch distance (P) parallel to central axis (I).

Geometric twist (δ), which is the change in vane angle between the two helical paths, is mathematically defined as:

$$\text{Geometric Twist } \delta=\beta-\alpha,$$

where, $$\alpha=\arctan(P/(2\cdot\pi\cdot R1\cdot\Theta/360°)), \text{ and}$$

$$\beta=\arctan(P/(2\cdot\pi\cdot R2\cdot\Theta/360°)), \text{ and}$$

$$R2<R1$$

for, helical path 7*d*1 at radius R1 described by pitch angle (or vane angle) α and traversing helical pitch distance P through angle of rotation Θ about central axis I, and helical path 7*d*2 at radius R2 described by pitch angle (or vane angle) β and traversing helical pitch distance P through angle of rotation Θ about central axis I.

To satisfy the above definition, the vane angle relative to diffuser face 1*a* and within the portion of geometric twist 19 reduces with increasing distance from central axis (I). This facilitates strong Coanda effect attachment of the peripheral airstream 6*a* to bellmouth 2 and face 1*a* in FIG. 2 to produce an air pattern substantially parallel to diffuser face 1*a*. The increased proximal vane angle allows for an increased airflow rate of the proximal airstream 6*b* due to the increased aperture vane angle closer to central axis (I). Again, proximal airstream 6*d* is induced by peripheral airstream 6*a* to produce a combined air stream that has a discharge pattern that is substantially parallel to diffuser face 1*a* and that has an airflow rate that is greater than would have been possible from a diffuser of the prior art (S) with vanes 7 that have a fixed vane angle or curvature. The strong Coanda effect attachment of the peripheral airstream 6*a* of diffuser 1 in accordance with the disclosure to bellmouth 2 and face 1*a*, due to the shallow peripheral vane angle, and the highly inductive characteristics of the discharged peripheral airstream 6*a* cause proximal airstream 6*b*, which is directed more strongly away from diffuser face 1*a* due to the steeper proximal vane angle, to be induced into a combined airstream that is directed to flow substantially parallel to diffuser face 1*a*, thereby increasing the total airflow rate discharged by the diffuser 1 in accordance with the disclosure at a given supply air pressure without altering discharge direction away from diffuser face 1*a*. This provides the benefit of allowing a smaller number of diffusers to be installed, reducing costs, or for more compact diffusers to be used, improving aesthetics, without increasing fan energy in either case, or for the same size and number of diffusers to be used whilst reducing fan energy requirements.

Figure 4:
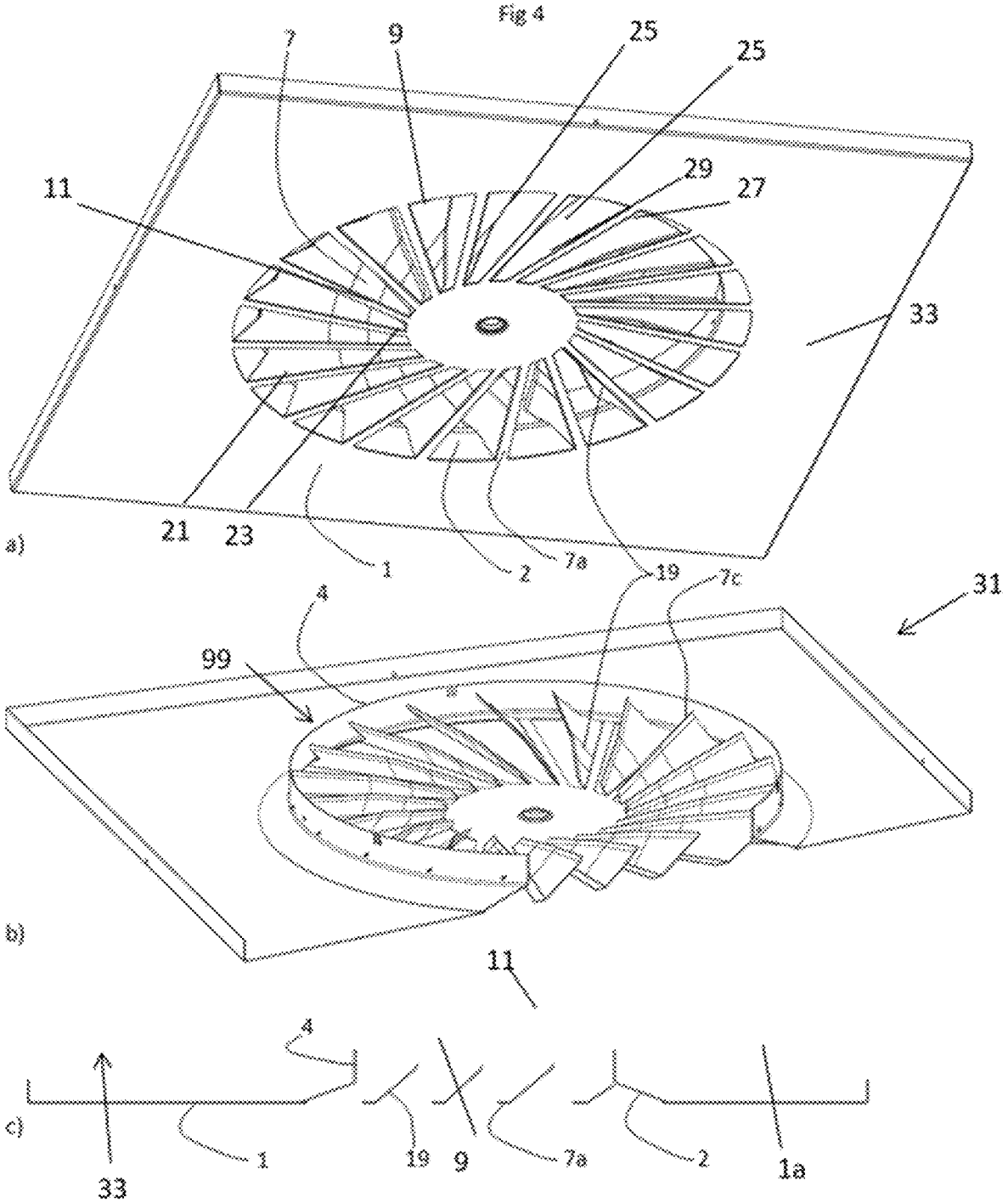
FIGS. 4*a* to 4*c* are diagrams illustrating an embodiment of a swirl diffuser with fixed discharge direction in accordance with the disclosure.
Figure 5:
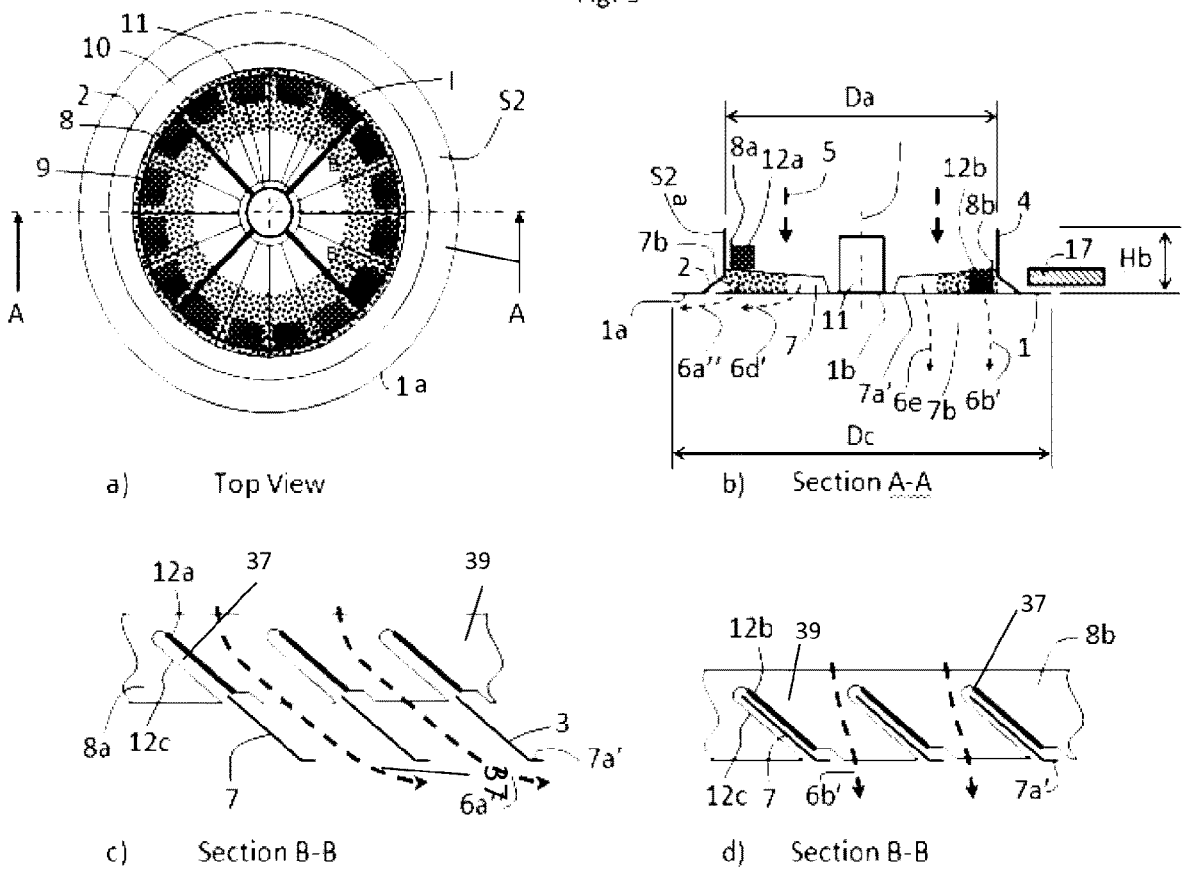
FIGS. 5*a* to 5*d* are diagrams illustrating an embodiment of a swirl diffuser incorporating discharge direction adjustment in accordance with the disclosure.

As shown in FIG. 4, each of the fixed vanes 7 is elongate, evenly spaced from an adjacent elongate vane. A peripheral portion 9 of the vane 7 is positioned at a distal end 21 of the elongate fixed vane 7. A second proximal portion 11 of the vane 7 is positioned at a proximal end 23 of the vane 7, the proximal end 23 being positioned towards the central axis (I) of the diffuser 1. A channel 25 is formed between adjacent pairs of fixed vanes 7. Each channel 25 is configured to allow the peripheral and proximal airstreams to pass between pairs of adjacent fixed vanes 7 and to the space.

Each channel 25 comprises first 27 and second 29 air passages. The first passage 27 is formed between the peripheral portions 9 of adjacent vanes 7 and is arranged to guide the peripheral air stream 6*a* in a first direction substantially in a plane of the diffuser face 1*a*. The second passage 29 is formed between the proximal portions 11 of adjacent vanes 7 and is arranged to guide the proximal air stream 6*b* in a second direction, the second direction being different from the first direction (e.g. the first airflow direction is at an acute angle to the second airflow direction). In one form, the angle between the first and second directions is between 5 and 30°. This corresponds with the angle between the first 9*a* and second 11*a* surfaces of the peripheral 9 and proximal 11 discharge elements, which is also between 5 and 30°. In one form, the angle between the first and second directions is between 7 and 15°. This corresponds with the angle between the first 9*a* and second 11*a* discharge element surfaces, which is also between 7 and 15°. In the illustrated form, the angle between the first and second directions is between approximately 10°. This corresponds with the angle between the first 9*a* and second 11*a* discharge element surfaces, which is also approximately 10°. In the detailed forms, the angle between the first 9*a* discharge element surface and the plane of the diffuser face (1*a*) is 38°. In the detailed forms, the angle between the second discharge element surface 11*a* and a plane of the diffuser face is 48°. In the detailed forms, the angle between the intermediate discharge element surface 19*a* and the plane of the diffuser face (1*a*) is 51°.

In the detailed embodiment, the diffuser 1 includes a housing 31 for supporting the plurality of fixed vanes 7. The housing 31 includes a plate 33 that is coplanar with the diffuser face 1*a* and a neck portion 4 extending from a central portion 99 of the plate 33 for connecting the diffuser 1 to an air source.

Diffusers may incorporate components that allow airflow direction adjustment, such as from a supply air pattern that is substantially parallel to the diffuser face to one that is substantially perpendicular to the diffuser face, or that alter the penetration of the supply air stream into the space relative to the plane of the diffuser face. In particular, the supply air stream direction or penetration may be adjusted to compensate for changes in the airflow rate or for changes in the supply-to-room air temperature differential. An example of the former may be a wall mounted diffuser discharging air substantially horizontally from an HVAC system with variable airflow rate, in which case, in order to maintain a substantially constant horizontal throw distance across the variable airflow rate range discharged by the diffuser, the discharge direction adjustment components are adjusted in response to the changing airflow rate to prevent over-throw at high airflow rates and under-throw at low airflow rates. An example of the latter may be a ceiling mounted diffuser in a high space such as an exhibition hall, discharging a constant airflow rate from an HVAC system with variable supply air temperature. In this case discharge direction adjustment and adjustment of penetration depth in response to the supply air temperature or to the supply-to-room air temperature differential are desirable so that cool supply air is not discharged downwards, thereby preventing draughts, and so that warm and buoyant supply air is discharged downwards, to provide penetration of the heat to floor level. The degree of downward discharge may be governed by the supply-to-room air temperature differential so as to compensate for changes to the relative buoyancy of the supply air stream relative to the room air, thereby achieving heating penetration to floor level without overthrow, achieving effective heating of the space to floor level without creating draughts. The adjustable discharge direction components may be manually adjusted, or regulated by means of thermally, electrically or pneumatically powered actuators.

The pressure drop of a supply air diffuser with adjustable discharge direction often alters as a function of discharge direction. The airflow rate discharged by the diffuser may, therefore, be substantially dependent upon the discharge direction of the diffuser. This is undesirable, as it, in turn, changes the amount of heating or cooling provided. This is exacerbated in systems with many diffusers connected to the same duct system, some of which may have different discharge direction settings to others due to differing supply-to-room temperature differentials or due to tolerance variances between the diffusers or hysteresis of their discharge direction adjustment mechanisms, thereby causing excessive cooling or heating capacity, and hence draughts from the lower pressure drop diffusers and insufficient cooling or heating capacity from those diffusers that have a higher pressure drop. Significant changes in diffuser pressure may also result in excessive fan power consumption, and "riding the fan curve", which can cause uncontrolled surging of the fan.

An alternative embodiment of the diffuser will now be described with reference to FIGS. 5 to 8. In this embodiment, the diffuser comprises an adjustment mechanism configured to alter the discharge direction of the combined air steam from the diffuser to the space. The adjustment mechanism, in the form of guide ring 8, is able to translate along the central axis (I) between a retracted position (shown in FIGS. 5*c*, 6*c* and 7*a-c*), whereby the adjustment mechanism is positioned adjacent (i.e. above in use—see FIG. 7*c*) the channels 25 such that the channels are unobstructed by the guide ring 8, and an advanced position (shown in FIGS. 5*d*, 6*d* and 8*a-c*), whereby the adjustment mechanism is positioned towards the diffuser face 1 such that it obstructs the channels 25.

When the guide ring 8 is in the retracted position (shown in FIGS. 5*c*, 6*c* and 7*a-c*), the proximal air stream is induced by the peripheral air stream to form a combined air stream that is supplied to the space in a direction that is substantially parallel with the plane of the diffuser face 1*a*. When the guide ring 8 is in the advanced position (shown in FIGS. 5*d*, 6*d* and 8*a-c*), the guide ring 8 interferes with the peripheral air stream 6*a* such that the combined airstream (6*e*, 60 is supplied in a direction that is substantially perpendicular with the plane of the diffuser face 1*a*. The negative pressure that forms beneath hub 1*a* in this instance further facilitates airflow substantially perpendicular with the plane of diffuser face 1*a*. The guide ring 8 is configured to translate and rotate within the neck 4 of the housing 31.

As shown in FIGS. 5*c-d* and FIGS. 7*c-d*, a plurality of slots 37 are formed in the wall 39 of the guide ring 8, each of the slots being configured to receive a fixed vane 7 upon translation and rotation of the guide ring 8 from the retracted position towards the advanced position. The slots 37 are configured to release a fixed vane upon translation and rotation of the guide ring 7 from the engaged position towards the retracted position. In the illustrated embodiment, the guide ring 8 further comprises a plurality of radially aligned guide vanes 12. Each guide vane 12 is connected to projects away from an internal 41 wall of the guide ring 8.

Figure 14:
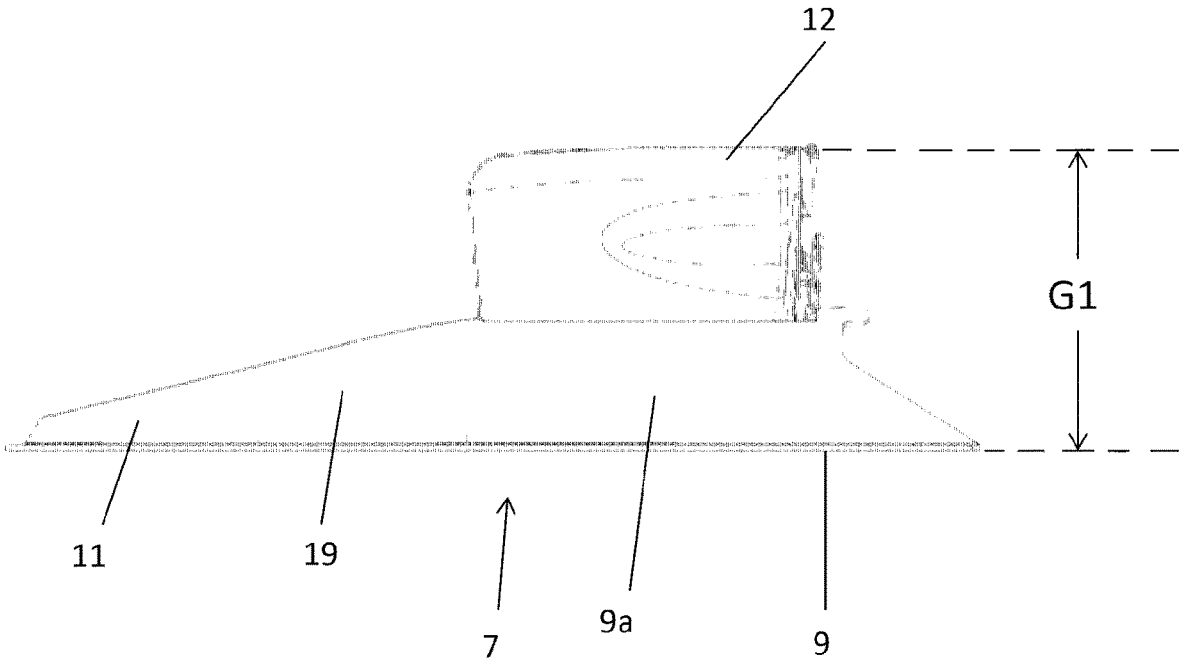
FIG. 14 is a diagram illustrating the embodiment shown in FIG. 13.
Figure 15:
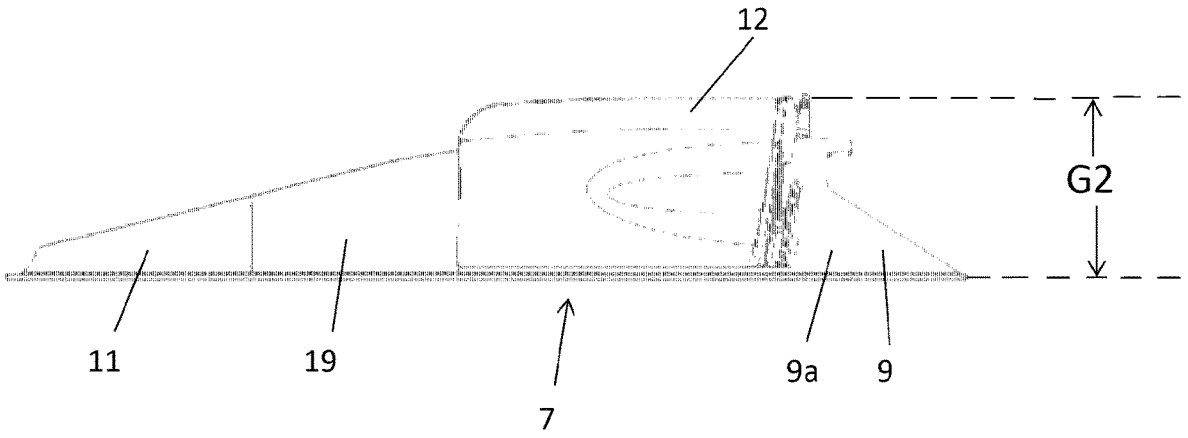
FIG. 15 is a diagram illustrating the embodiment shown in FIG. 12.

An underside surface 43 of each guide vane 12 is complementary in shape to the peripheral air guide surface 9*a* of the fixed vane peripheral portion 9 such that translation and rotation of the guide ring 8 from the retracted position towards the engaged position causes each guide vane 12 to slide over the first air guide surface 9*a* of the fixed vanes. In use, each guide vane 12 and adjacent second peripheral portion 11 of each fixed vane 7 together form an extended diffuser blade. As shown in FIG. 14, when the guide ring 8 is in the retracted position, each guide vane 12 is positioned such that it forms an extension of the second peripheral portion 11 of each fixed vane 7 to thereby increase a guidance width (shown as G1 in FIG. 14) of the diffuser blade (i.e. produce a wide diffuser blade). As shown in FIG. 15, when the guide ring 8 is in the engaged position, each guide vane 12 is positioned over the second peripheral portion 11 of each fixed vane 7 to thereby decrease the guidance width (shown as G2 in FIG. 15) of the diffuser blade (i.e. produce a relatively narrow diffuser blade). The embodiment of the present disclosure that includes an adjustment mechanism and secondary adjustable vanes 12 will now be described in further detail with reference to FIGS. 5 to 10.

In the detailed embodiments, a single guide ring is shown that translates along the periphery of the diffuser. It will be apparent to a person skilled in the art that many that different configurations could also be implemented. For example, the diffuser could include a second guide ring that translates along the inside (i.e. along the central axis and positioned adjacent the central hub) of the diffuser. In this embodiment, the adjustable vanes could extend (i.e. either part way or could span the full length between the guide rings) between the two guide rings to thereby increase the guidance width of the fixed diffuser vanes. Further, the guide ring may be split into segments that perform differing functions. Alternative embodiments of the diffuser will be described in relation to FIGS. 16-27.

FIG. 5*b* is a diagram illustrating a side section view of the ceiling swirl diffuser (S2) shown in FIG. 4*a*, in which supply air stream 5 flows into the neck 4 of diffuser S2 and onto substantially radially aligned swirl vanes 7 to be discharged from face 1 as a swirling air stream directed substantially parallel (6*a*" & 6*d*') to diffuser face 1*a*. An adjustable guide ring, which may be raised 8*a* or lowered 8*b* by adjustment mechanism 11 has guide vanes fixedly attached to it, which are raised 12*a* or lowered 12*b* as the guide ring is adjusted up or down 8*a* and 8*b*, respectively to alter discharge direction from substantially parallel (6*a*" and 6*d*') to substantially perpendicular (6*b*' and 6*e*) to diffuser face 1*a*. Not shown are guide ring positions between those depicted in FIGS. 5*c* and 5*d*, which allow discharge direction to be modulated between substantially parallel (6*a*" and 6*d*') and substantially perpendicular (6*b*' and 6*e*).

The range of geometric twist 19, located towards the periphery of the substantially radial vanes 7 so as to provide a shallow vane angle adjacent to bell mouth 2 to facilitate airflow attachment of discharged swirl airstream (6*a*" and 6*d*') to the face 1 ([illegible] , allows for an increasing vane angle relative to diffuser face 1*a* and of equal helical pitch (P) closer to central axis (I), thereby increasing the amount of air that may be discharged by the diffuser (S1).

The adjustable vanes (12*a*—retracted/raised position, and 12*b*—engaged/lowered position) have geometric twist of the same helical pitch (P) as the fixed vane geometric twist 19. Guide ring (8*a*—retracted/raised position, and 8*b*—engaged/lowered position) twists as it is raised and lowered, respectively, to traverse the same helical path as that of the adjoining fixed vanes so that each adjustable vane (12*a* and 12*b*) slides along the adjoining fixed vanes within the range of geometric twist 19, to alter discharge direction from substantially parallel (6*a*" and 6*d*') to substantially perpendicular (6*b*' and 6*e*) to diffuser face 1*a*.

FIGS. 5*c* and 5*d* are section views illustrating the guide ring raised 8*a* (FIG. 5*c*) and lowered 8*b* (FIG. 5*d*), and that the guide ring has slots 37 of the same angle as the adjoining fixed vane 7 within the range of geometric twist 19. Each fixed vane may have trailing edge 7*a*'. Fixedly attached to the upper edge of each slot 37 is a guide vane which may be raised 12*a* or lowered 12*b* by sliding along the adjoining fixed vane 7 so that the chord (i.e. dimension from leading edge to trailing edge, shown as G1 in FIG. 14) of the combined vane is increased (as represented by width G1 in FIG. 14) by extending the leading edge 12*a* or decreased (as represented by width G2 in FIG. 15) by retracting the leading edge 12*b* to increase or decrease the swirl effect imparted upon the air stream, thereby discharging substantially parallel airflow 6*a*" or substantially perpendicular airflow 6*b*', respectively, to diffuser face 1*a*. In other words, the surface area of the diffuser blade is increased when the ring is retracted (i.e. a wider expanse of blade surface is provided for air to flow across, which increases the depth of the channel, thereby increasing the degree by which channel redirects the airflow direction.

Due to the range of geometric twist 19, for a given neck diameter (Da) and airflow rate of supply airstream 5, the face diameter (Dc) of the diffuser (S2) in accordance with the disclosure may be smaller than the face diameter (Db) of a diffuser of the prior art without compromising stable parallel discharge patterns (6*a*" and 6*d*') to face plane 1*a* even in freely suspended applications, especially when discharging low airflow rates of low temperature supply air. This allows for a more compact design, reducing the aesthetic impact of diffuser 1 in the space and reducing transport and storage costs of the diffuser.

Due to the range of geometric twist 19, for a given neck diameter (Da) and airflow rate of supply airstream 5, the pressure drop of the diffuser 1 in accordance with the disclosure may be smaller than that of a diffuser of the prior art (S) with constant vane angle or vane radius across the length of vane 7, without compromising stable parallel discharge patterns (6*a*" and 6*d*') to diffuser face 1*a* even in freely suspended applications, especially when discharging low airflow rates of low temperature supply air. This saves fan energy or allows larger airflow rates to be discharged at the same pressure drop produced by diffusers of the prior art.

Due to the range of geometric twist 19, the guide ring (8*a* and 8*b*) and guide vanes (12*a* and 12*b*) may slide up and down along the fixed vanes in the range of geometric twist 19, respectively, altering combined vane chord length by extending 8*a* or retracting 8*b* the leading edge to discharge a substantially parallel (6*a*" and 6*d*') or perpendicular (6*b*' and 6*e*) air pattern. The substantially parallel (6*a*" and 6*d*') and substantially perpendicular (6*b*' and 6*e*) patterns are stronger than the substantially parallel 6*a* and substantially perpendicular 6*b* patterns of the swirl diffuser of the prior art (S) of equal neck diameter (Da) and airflow rate 5, thereby providing better turndown potential when cooling and better heating penetration.

FIGS. 6*a* to 6*d* are diagrams illustrating that the guide ring may be reduced in diameter (8*c*—represents the guide ring in the raised/retracted position, and 8*d*—represents the guide ring in the engaged/lowered position) and annular neck reducer 13' (e.g. collar) may be located between the guide ring (8*c* and 8*d* and the neck 4 to reduce the open area and thereby throttle the airflow 5, whilst allowing discharge direction adjustment from substantially parallel (6*c*' and 6*d*')

to substantially perpendicular (6*b*" and 6*e*) to face plane 1*a*, as described in FIGS. 5*a* to 5*d*. The reducer 13' with the guide ring of reduced diameter (8*c* and 8*d*) and guide vanes to suit (12*a*' and 12*b*') allows diffusers of the same size to be used for a broadened range of airflow rates, thereby providing architects with a substantially uniform diffuser aesthetic for a large range of applications, which is generally preferred. It also reduces tooling costs, as diffuser sizes that are provided for by neck reducers with smaller guide rings may be skipped, and reduces the variety of diffusers that need to be stocked, as standard guide rings (12*a* and 12*b*) may easily be swapped for neck reducers 13' and guide rings of reduced diameter (8*c* and 8*d*) with associated adjustable vanes (12*a*' and 12*b*').

FIGS. 7*a* to 7*c* show the adjustment mechanism in the raised/retracted position, are illustrates a bottom, a truncated top, and a side section view through the truncation, respectively, of an embodiment of the disclosure with twenty substantially radially aligned vanes 7, each with a peripherally located range of geometric twist 19 and trailing edge 7*a*', bell mouth 2, neck 4, and substantially flush face 1 with central fastening hole 1'. Guide ring 8*a* and guide vanes 12*a* are shown in the raised position to discharge an air stream substantially parallel to face plane 1*a*.

Figure 7:
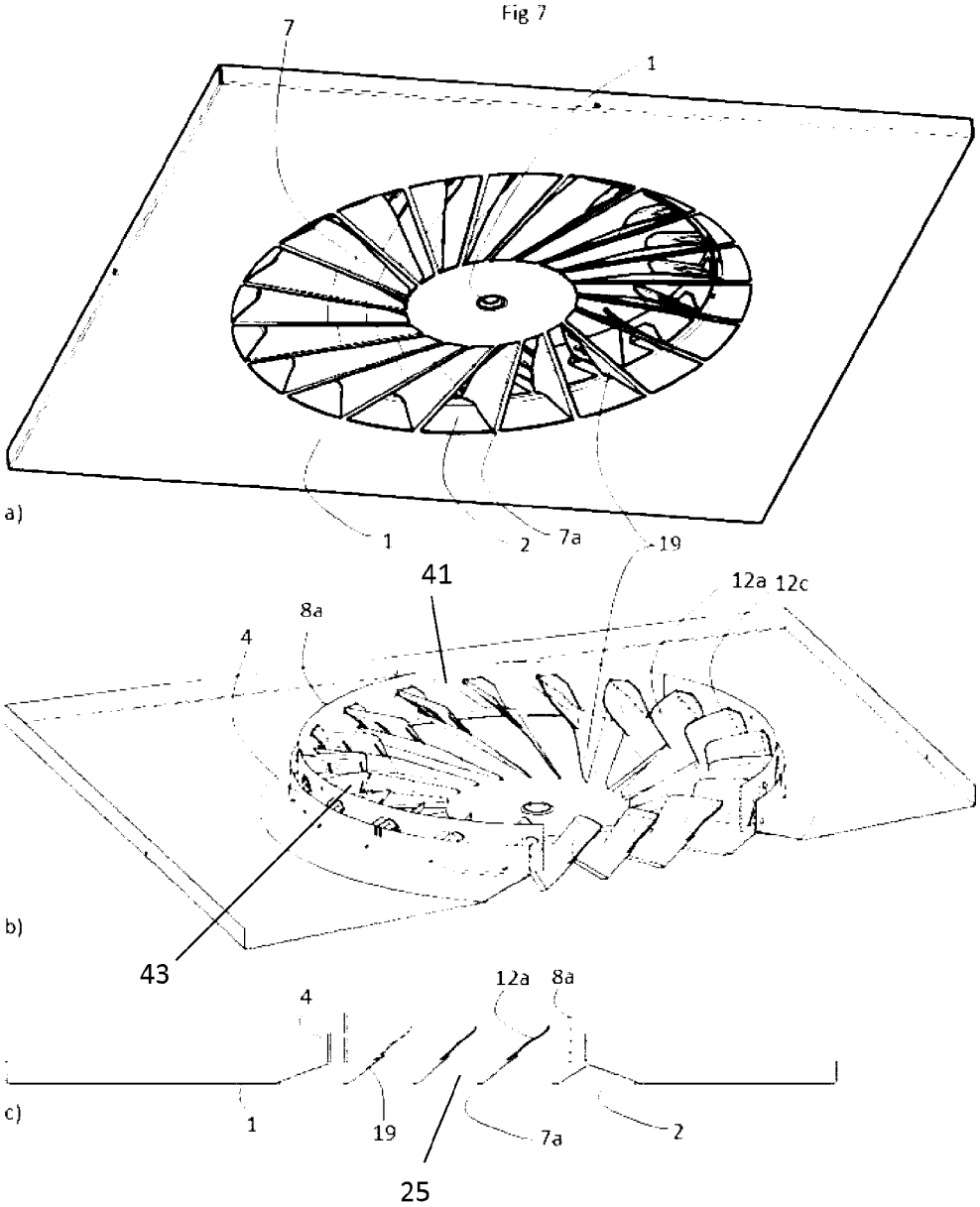
FIGS. 7*a* to 7*c* are diagrams illustrating an embodiment of a swirl diffuser incorporating discharge direction adjustment set for discharge parallel to the diffuser face in accordance with the disclosure.

FIGS. 8*a* to 8*c* show the adjustment mechanism in the lowered/engaged position, and illustrates a bottom, a truncated top, and a side section view through the truncation, respectively, of the embodiment of the disclosure shown in FIG. 7 with guide ring 8*b* and guide vanes 12*b* shown in the lowered position to discharge an air stream substantially perpendicular to face plane 1*a*.

FIGS. 9*a* to 9*c* are diagrams illustrating a bottom, a truncated top, and a side section view through the truncation, respectively, of an embodiment of the disclosure with twenty substantially radially aligned vanes 7, each with a peripherally located range of geometric twist 19 and trailing edge 7*a*', bell mouth 2, neck 4, and substantially flush face 1 with central fastening hole 1', as shown in FIG. 7. Reducer 13', reduced guide ring 8*c* and guide vanes 12*a*' are shown in the raised position to discharge an air stream of reduced airflow rate substantially parallel to face plane 1*a*.

Figure 9:
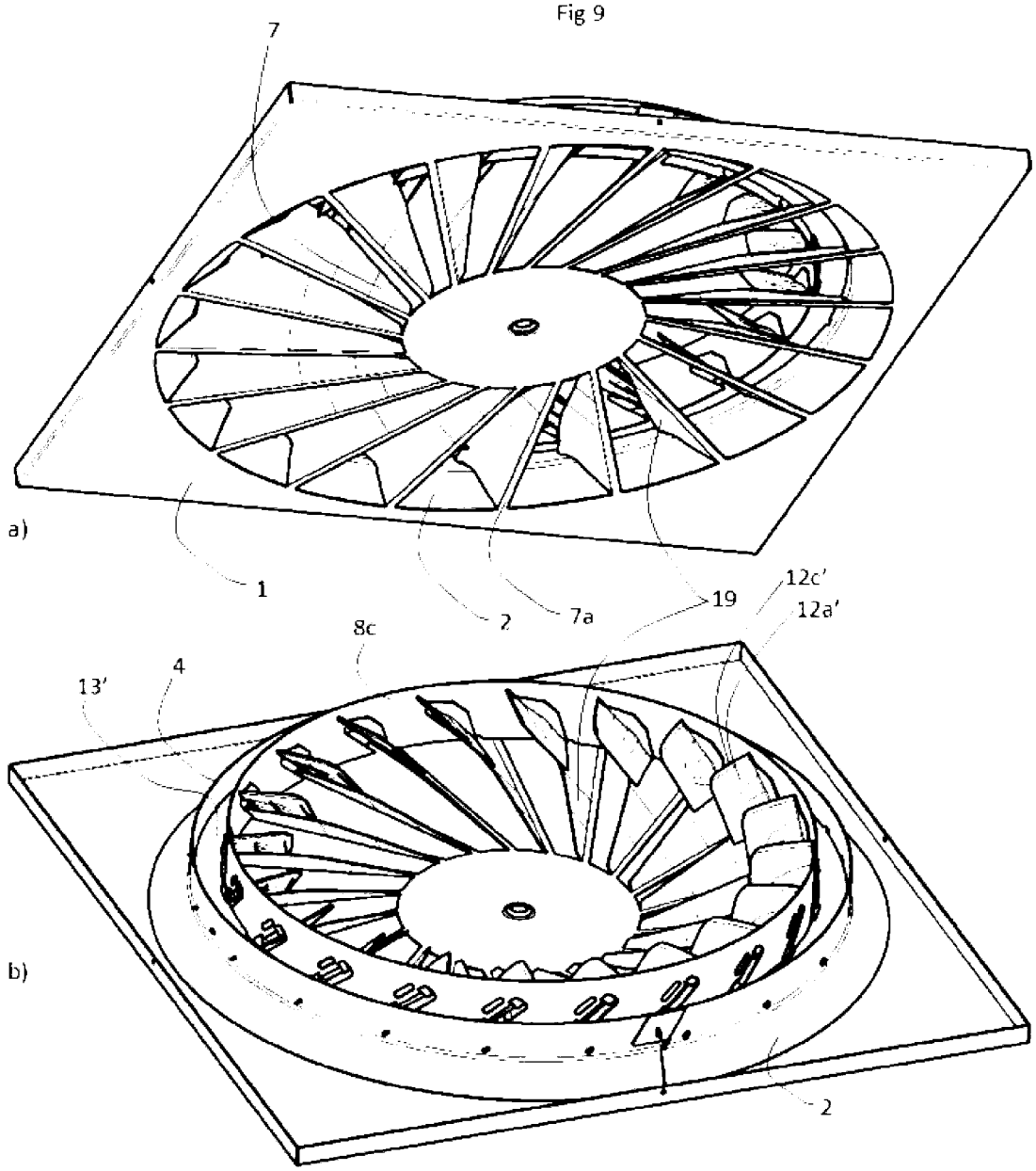
FIGS. 9*a* and 9*b* are diagrams illustrating an embodiment of the disclosure with neck reducer and adjustable discharge direction set for discharge parallel to the diffuser face.
Figure 10:
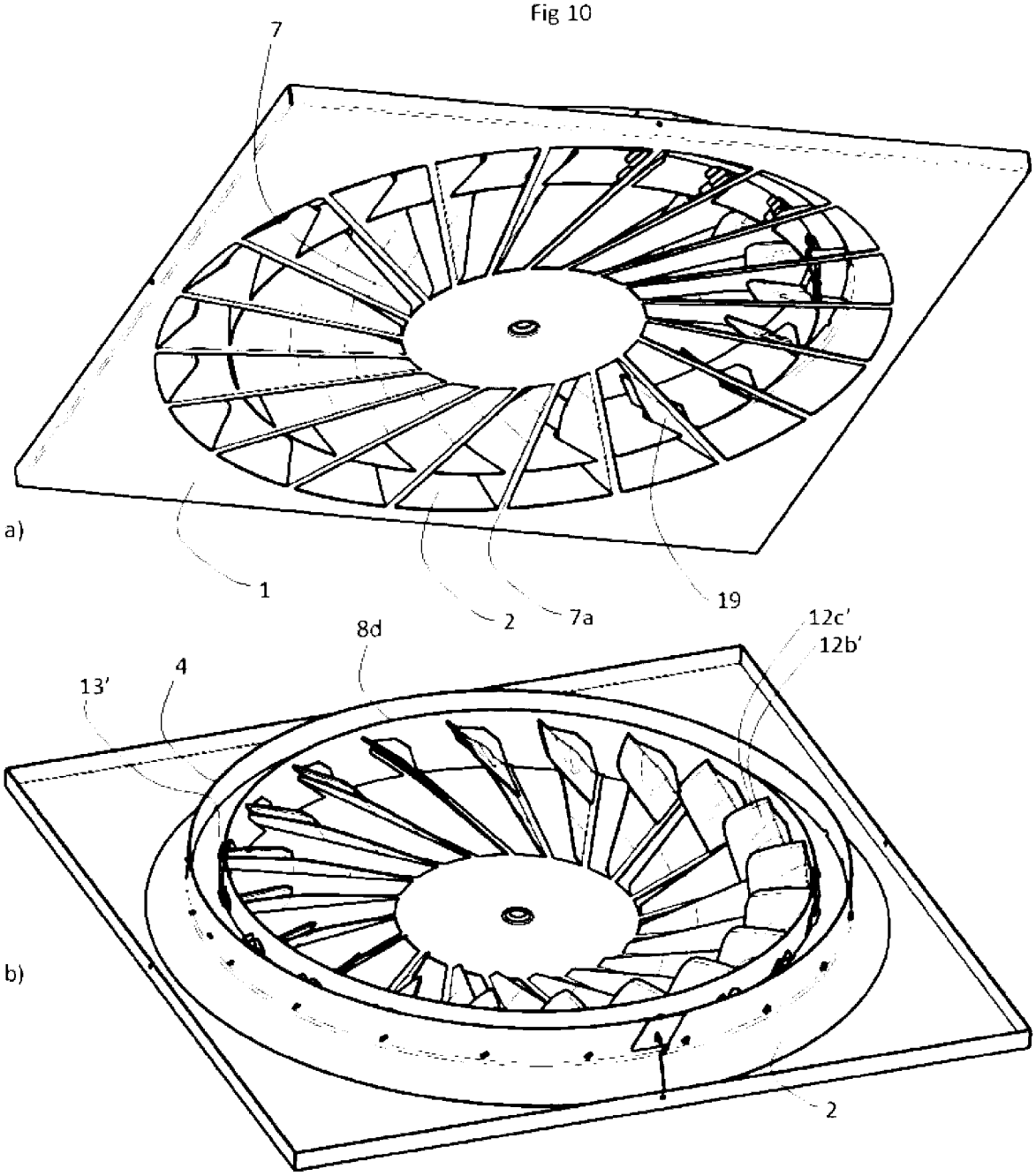
FIGS. 10*a* and 10*b* are diagrams illustrating the embodiment of the disclosure with neck reducer shown in FIGS. 9*a* and 9*b* with adjustable discharge direction set to discharge perpendicular to the diffuser face.

FIGS. 10*a* to 10*c* are diagrams illustrating a bottom, a truncated top, and a side section view through the truncation, respectively, of the embodiment of the disclosure shown in FIG. 9 with reduced guide ring 8*d* and guide vanes 12*b*' shown in the lowered position to discharge a reduced air stream substantially perpendicular to face plane 1*a*.

Figure 6:
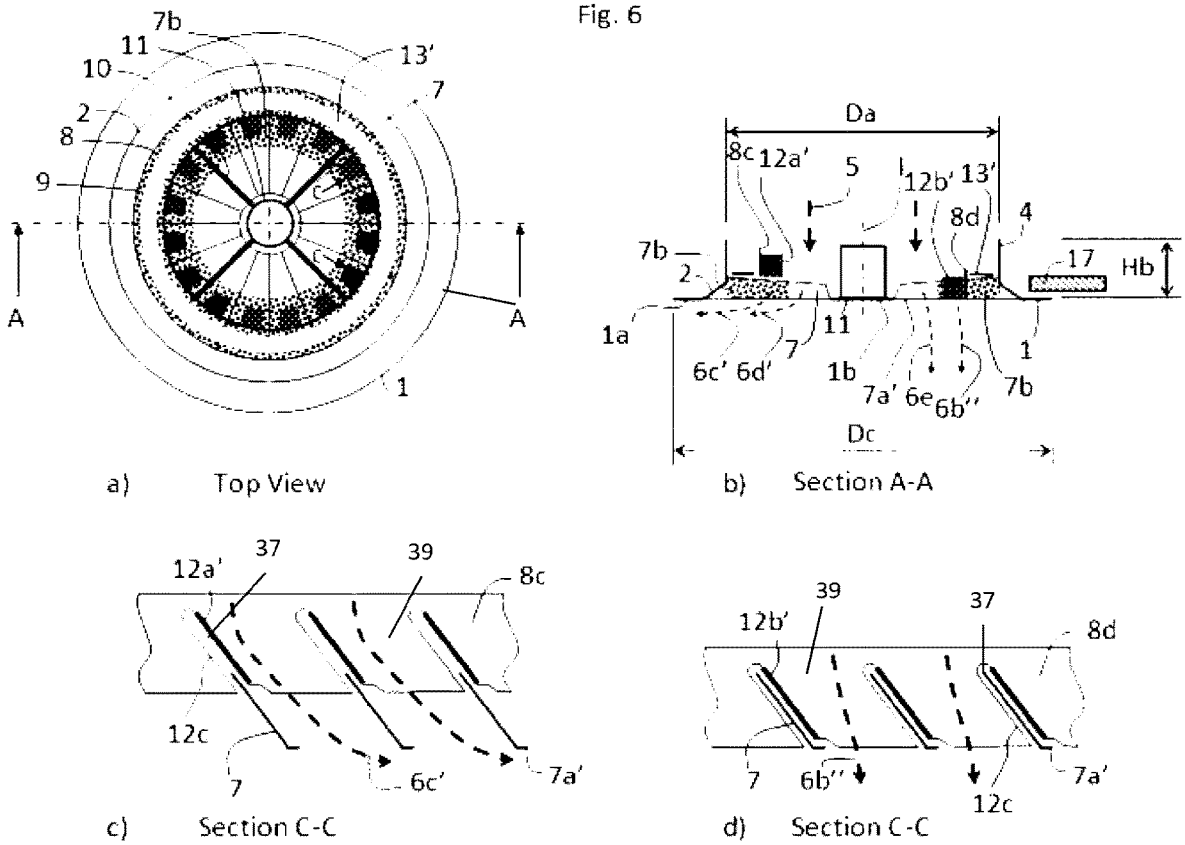
FIGS. 6*a* to 6*d* are diagrams illustrating an embodiment of a swirl diffuser incorporating discharge direction adjustment in accordance with the disclosure.

FIGS. 11*a* and 11*b* are diagrams of a section showing the end view of a substantially radial vane 7 of the embodiment in FIG. 6, illustrating the range of geometric twist 19, the cambered leading edge 7*c*, the trailing edge 7*a*, as well as the neck 4, bell mouth 2, and face plane 1*a*.

The peripheral and proximal vane angles of the range of geometric twist 19, relative to face plane 1*a*, are approximately 38° and 48°, respectively. The vane angle abutting hub 1*b* is approximately 48°, and the steepest vane angle is approximately 51°. The neck 4 to hub 1*b* ratio is approximately 2.7:1. The ratio of the peripheral and proximal diameters of the range of geometric twist 19 is approximately 1.4:1. The ratio of the neck 4 to trailing edge 7*a* varies from approximately 50:1 to 40:1 at the hub 1*b* and neck 4 diameters, respectively.

Figure 8:
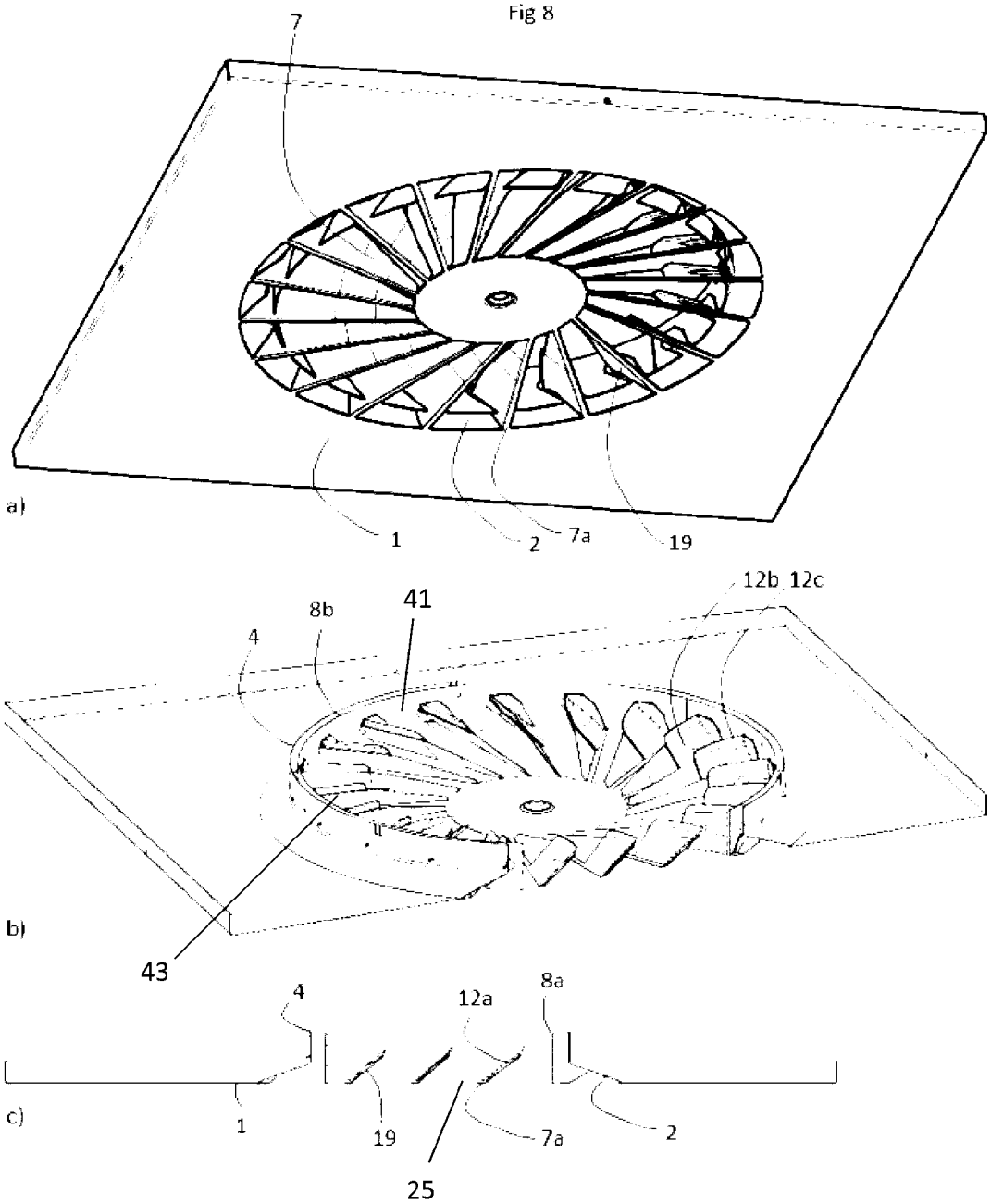
FIGS. 8*a* to 8*c* are diagrams illustrating the embodiment of the swirl diffuser shown in FIGS. 7*a* to 7*c* in accordance with the disclosure incorporating discharge direction adjustment set for discharge perpendicular to the diffuser face.
Figure 11:
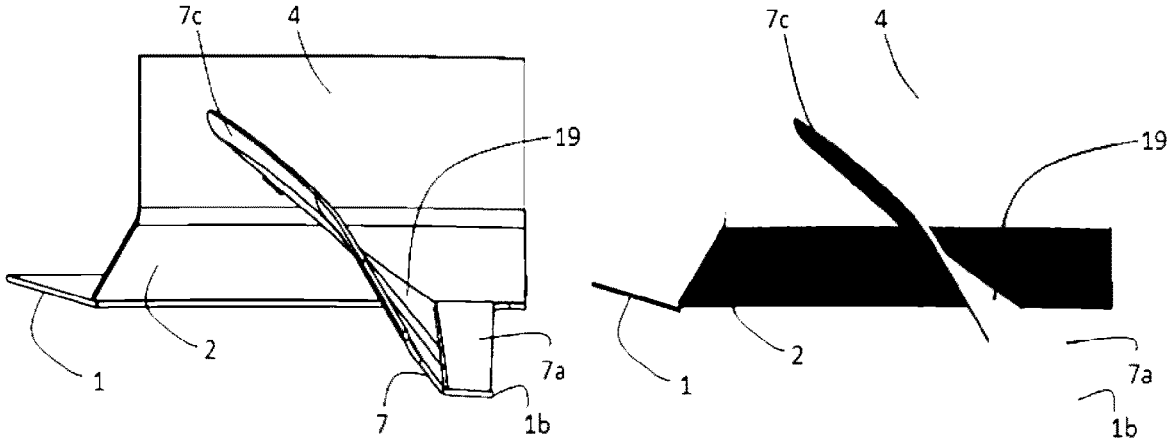
FIGS. 11*a* and 11*b* are diagrams illustrating a vane of a swirl diffuser with fixed discharge direction in accordance with the disclosure.

FIGS. 12*a* and 12*b* are diagrams of a section showing the end view of a substantially radial vane 7 of the embodiment in FIG. 8, illustrating the vane angles as described in FIG. 11 and showing that the cambered leading edge of fixed vane 7 has been removed and the trailing edge 7*a* has been shortened. Guide ring 8*b* with guide vane 12*b* is in the lowered position. Adjustable vane 12*b* has helical geometric twist of the same pitch as that of fixed vane 19, and additionally has a cambered leading edge 12*c*'. The ratio of the neck 4 to trailing edge 7*a* is approximately 90:1.

Figure 12:
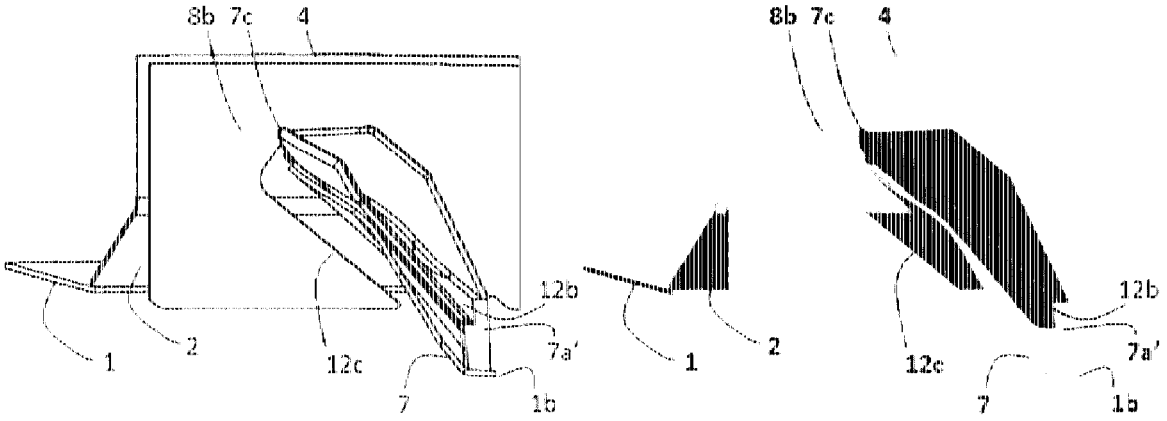
FIGS. 12*a* and 12*b* are diagrams illustrating a fixed vane and an adjustable vane set for discharge perpendicular to the diffuser face, in accordance with the disclosure.
Figure 13:
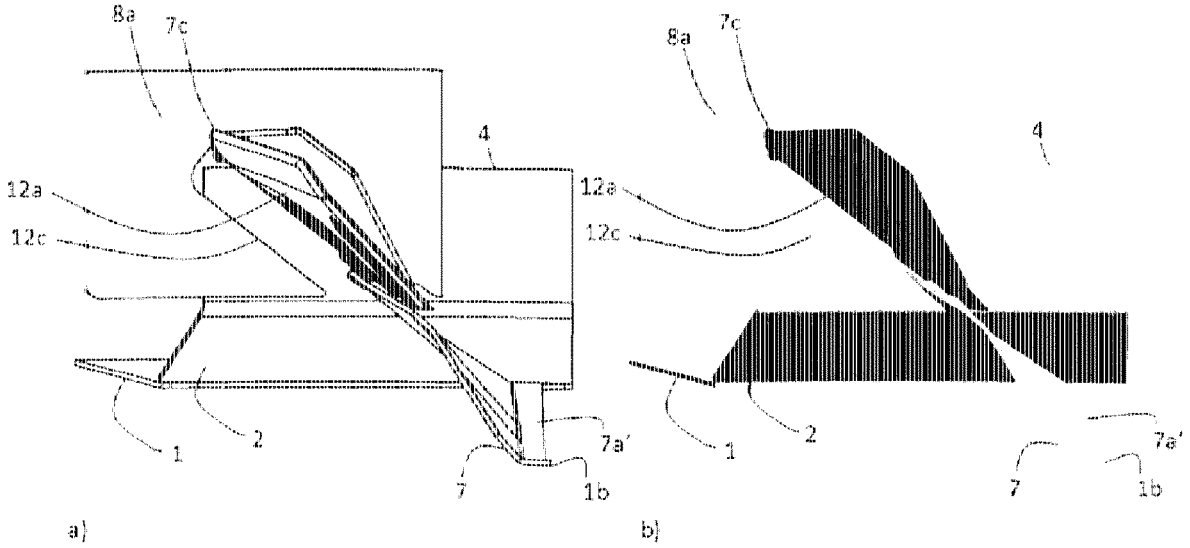
FIGS. 13*a* and 13*b* are diagrams illustrating the embodiment shown in FIG. 12 set for discharge parallel to the diffuser face.

FIGS. 13*a* and 13*b* are diagrams of the same vane section shown in FIG. 12 with the guide ring 8*b* and adjustable vane 12*b* in the raised position.

In the detailed embodiments, a single guide ring is shown that translates along the periphery of the diffuser. It will be apparent to a person skilled in the art that many different configurations could also be implemented. For example, the diffuser could include a second guide ring that translates along the inside (i.e. along the central axis and positioned adjacent the central hub) of the diffuser. In addition, the guide ring could be segmented. Various alternative embodiments of the diffuser will now be described in relation to FIGS. 16-27.

Figure 16A:
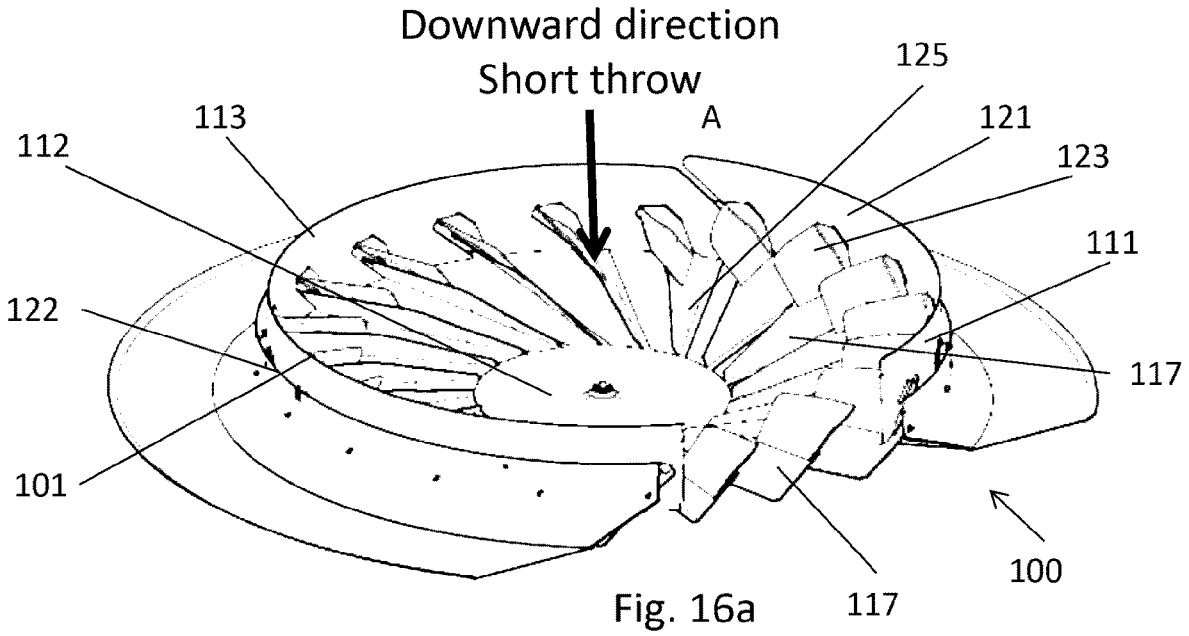
FIG. 16*a-b* shows a perspective view (a) and a cross section (b) through an embodiment of the diffuser whereby the direction and throw adjustment guide ring segments are in the retracted position.

FIG. 16 shows a diffuser 100 having a segmented guide ring 101. The diffuser 100 is configured to vary the discharge direction of the supplied airstream between a first direction that is substantially inclined to the diffuser face (see FIGS. 21*a-b*) and a second direction that is substantially perpendicular to the diffuser face (see FIGS. 18*a-b*). The diffuser 100 is also configured to vary the throw, measured substantially perpendicular to the diffuser face, of the supplied airstream between a first relatively long throw (see FIGS. 18*b* & 21*a*) and a second relatively short throw (see FIGS. 18*a* & 21*b*). Arrow A in FIG. 16*a* denotes the oncoming air supply to the diffuser (i.e. the air supplied from an upstream fan assembly).

FIG. 16*a* is a perspective view of the diffuser 100 from the air intake side of the diffuser. In this embodiment, the guide ring includes a segmented guide ring 101. A first guide ring segment, in the form of a direction adjustment mechanism 111, is configured to control the direction of the discharged supply air stream. A second guide ring segment, in the form of a throw adjustment mechanism 113, is configured to control the throw of the discharged supply air stream. In the disclosed embodiments, the length of the direction adjustment ring segment 111 is equal to or shorter than the length of the throw adjustment ring segment 113. In one embodiment, the direction adjustment ring segment 111 is approximately half the length of the throw adjustment ring segment 113 (i.e. the direction adjustment ring segment 111 is approximately one third of the circumferential length of the complete ring and the throw adjustment ring segment 113 is approximately two thirds of the circumferential length of the complete ring 101). In other forms, the ratio of lengths of the first segment to second segment may vary in dependence on the size and intended use of the diffuser.

The operation of the guide ring segments 111,113 is similar to the guide ring described with reference to FIGS. 4-15. However, importantly, the ring segments 111,113 are able to translate and rotate along and about the central axis of the diffuser independently of one another. The direction adjustment guide ring segment 111 is able to translate along the central axis of the diffuser (i.e. an axis perpendicular to the diffuser face positioned at the centre of the diffuser) between a retracted position and an advanced position. In the retracted position, the direction adjustment guide ring segment 411 is positioned such that the channels 115 between adjacent diffuser vanes 117 are unobstructed by the direction adjustment guide ring segment 111. In the advanced position, the direction adjustment guide ring segment 111 is positioned away from the diffuser intake 118 (i.e. towards the diffuser face 124) such that it obstructs the flared exit 120 between the diffuser neck 122 and the diffuser face 124.

When the direction adjustment guide ring segment 111 is in the retracted position, a proximal air stream (i.e. an air stream that is discharged through a portion of the channel 115 that is disposed towards the centre of the diffuser is able to be induced by a peripheral air stream (i.e. an air stream that is discharged through a portion of the channel 115 that is disposed towards the periphery of the diffuser). A combined air stream is formed that is supplied to the space in a direction that is substantially inclined to the central axis of the diffuser. When the direction adjustment guide ring segment 111 is in the advanced position, the direction adjustment guide ring 111 interferes with (e.g. cuts off or deflects) the peripheral air stream such that the proximal airstream is supplied in a direction that is less inclined to the central axis of the diffuser. The direction adjustment guide ring segment 111 rotates about the central axis of the diffuser upon translation between the advanced and retracted positions. Rotation of the direction adjustment segment 111 during translation allows the guide ring to slide over diffuser fixed vanes 117.

Figure 16B:
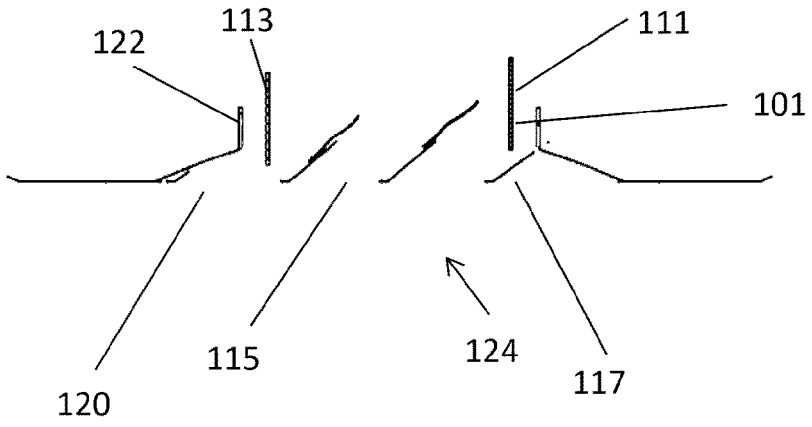

The throw adjustment guide ring segment 113 is also able to translate between retracted and engaged positions to alter the cross-sectional area of the diffuser and thereby adjust the throw of the supply air stream. In the advanced position, the throw guide ring segment 113 effectively reduces the cross-sectional area of the diffuser face and the spread of the discharged air by cutting off the airflow at the periphery of the diffuser from discharging through flared exit 120. As such, for a given airflow rate, the spread of the discharged airstream is reduced, thereby concentrating the airstream, which therefore has an increased throw relative to when the throw adjustment ring segment 113 is in the retracted position FIGS. 16*a-b* show both the direction adjustment guide ring segment 111 and the throw adjustment guide ring segment 113 in substantially retracted positions. FIG. 16*b* shows a cross-section through the diffuser of FIG. 16*a*. The discharge direction of supply air 110*a* shown in FIG. 18*a* corresponds with the retracted positions of the direction 111 and throw 113 adjustment guide ring segments shown in FIGS. 16*a-b*. In this setting, the negative pressure that forms downstream of the central hub 112 assists in preventing the discharged air from spreading excessively by drawing the discharged air towards the centre of the diffuser. FIGS. 16*a-b* show the discharge direction guide ring 111 slightly more strongly retracted than the throw adjustment guide ring 113. This causes the air discharged by the discharge direction segment 111 to be biased with a stronger incline than the discharged air from the throw adjustment segment 113. The downward incline of the air discharged by the discharge direction segment induces the air discharged by the throw adjustment segment to also have a downward incline. Thus, the combined air stream 110*a* is inclined downwards relative to the diffuser face 124 in the form of an asymmetrical swirling airstream relative to the diffuser central axis.

In the embodiment shown in FIGS. 16-20, both the direction adjustment and throw adjustment ring segments further comprise a plurality of substantially radially aligned guide vanes 123. The guide vanes are structurally similar to the guide vanes described with reference to FIGS. 4 to 15. Depending on the shape of the fixed vanes, the guide vanes 123 may or may not include a geometric twist across their length. Similarly, throw adjustment guide ring segment 113 is shown with respective guide vanes 123 attached to it that slide over respective fixed vanes 117, which may or may not include a geometric twist across their length. When a guide ring segment 111 or 113 is in the retracted position its respective guide vanes 123 are extended to maximise the width of the respective channels 115. This maximises the inclination of the air discharged by the respective channels 115 relative to the diffuser central axis. When a guide ring segment 111 or 113 is in the advanced position its respective guide vanes 123 are retracted to minimise the width of the respective channels 115. This minimises the inclination of the discharged air relative to the diffuser central axis.

The effect of the guide vanes 123 on the airflow direction and throw compliments the effect of the guide ring segments 111 & 113 on the airflow direction and throw, respectively, thereby pronouncing adjustability of the airflow direction relative to the diffuser central axis and airflow throw measured substantially perpendicular from the diffuser face. Furthermore, the combined adjustment of each guide ring segment 111 and 113 with its respective guide vanes 123 results in a substantially neutral net change in pressure loss. This is because retracting a guide ring 111 or 113 reduces the pressure loss as the respective airflow channels 115 are opened to the flared exit 120, whilst the simultaneous extension of the respective guide vanes 123 increases the pressure loss by a similar amount; and vice versa. The net result is a substantially zero change in pressure loss regardless of the discharge direction or throw adjustment settings.

It will be apparent to a person skilled in the art that when equipped with guide vanes 123, guide rings 111 and/or 113 may be configured not to obstruct flared exit 120 when in the advanced position, or to fully obstruct flared exit 120 even in the retracted position, as in such embodiments the retracted and advanced positions of the guide ring relative to the flared exist merely compliment the effect of the guide vanes on the direction of the air discharged by each channel 115.

Figure 17A:
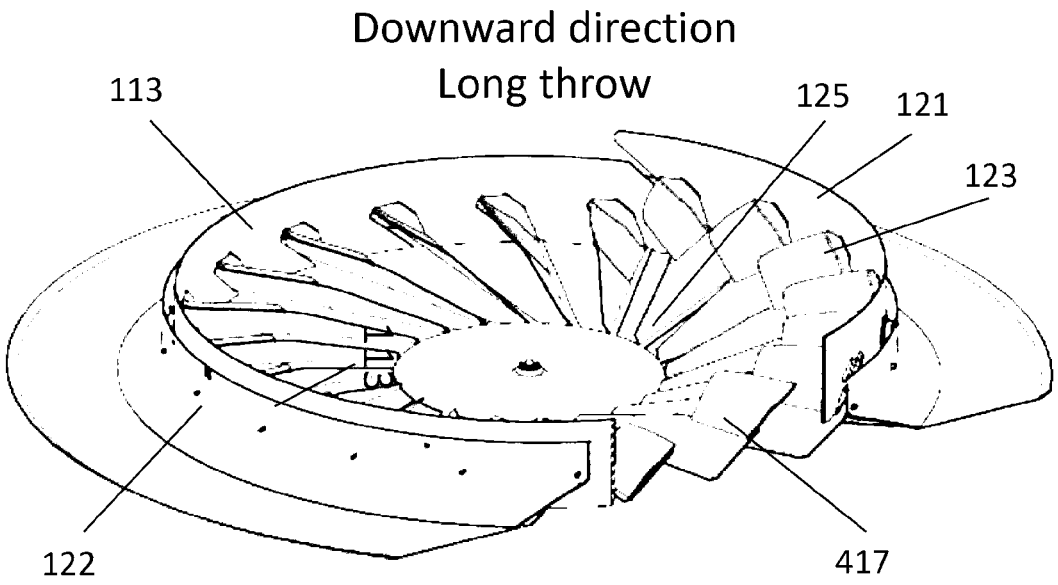
FIG. 17*a-b* shows a perspective view (a) and a cross section (b) through the embodiment of the diffuser shown in FIG. 15 whereby the direction adjustment guide ring segment is in the retracted position and the throw adjustment guide ring segment is in the advanced position.
Figure 17B:
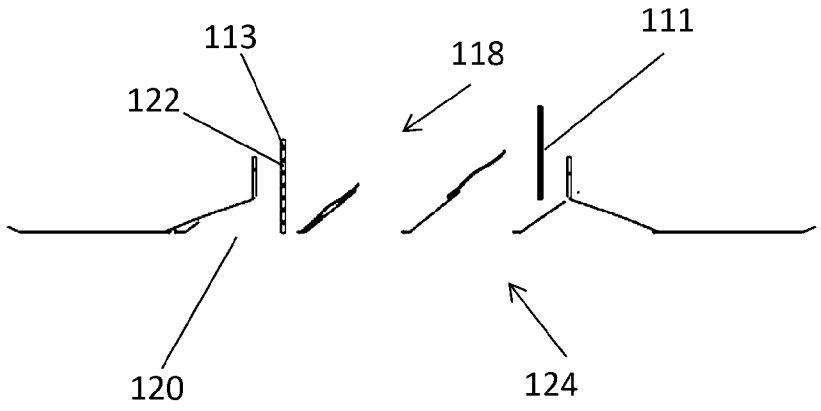
Figure 18A:
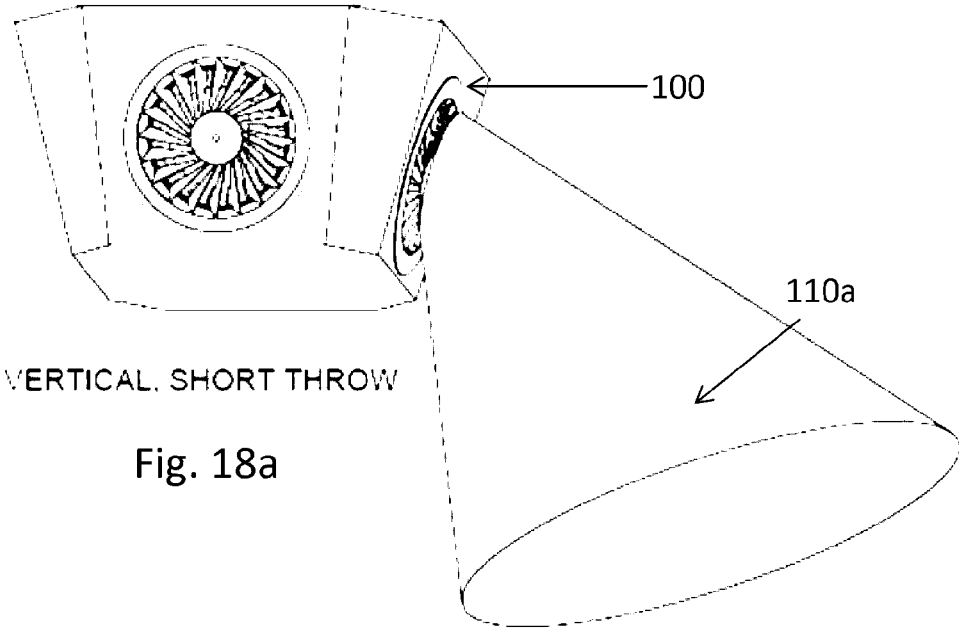
FIGS. 18*a-b* show a view of the supply air pattern for the diffuser disclosed with reference to FIG. 16 (*a*) and FIG. 17 (*b*)
Figure 18B:
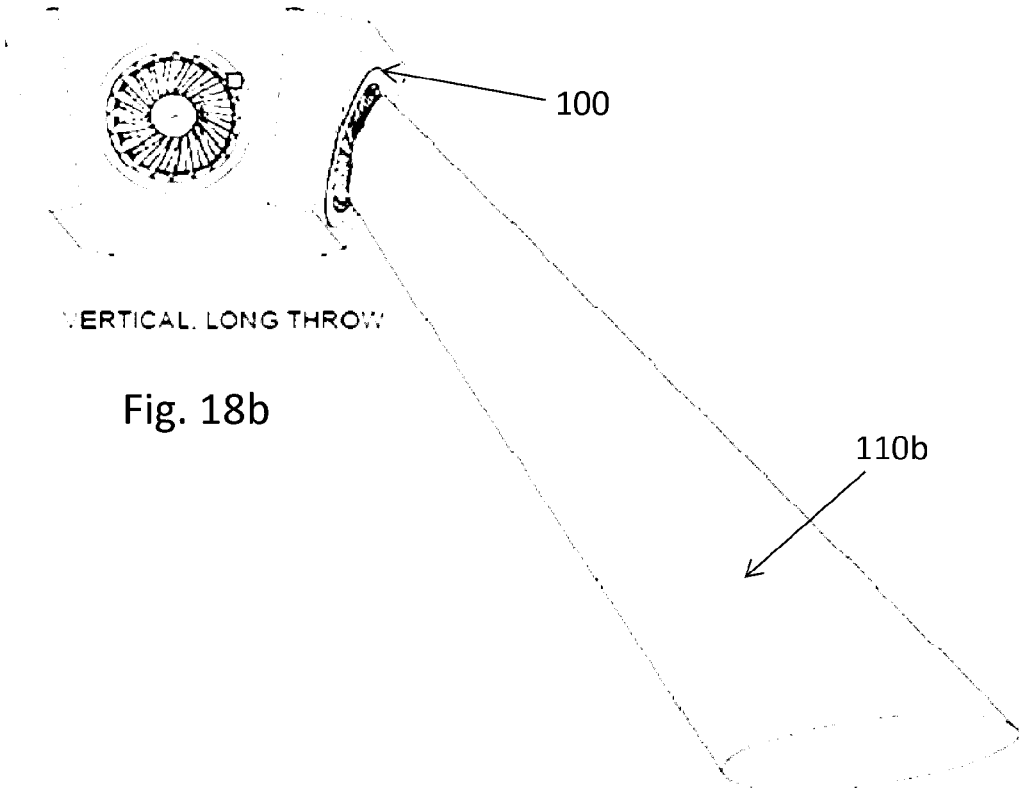

FIG. 17*a-b* show the direction adjustment guide ring segment 111 in the retracted position and the throw adjustment guide ring 113 segment in the advanced position. The resultant discharge of the diffuser is strongly inclined relative to the central axis of the diffuser face with long throw (see airflow pattern 110*b* shown in FIG. 18*b*).

Figure 19A:
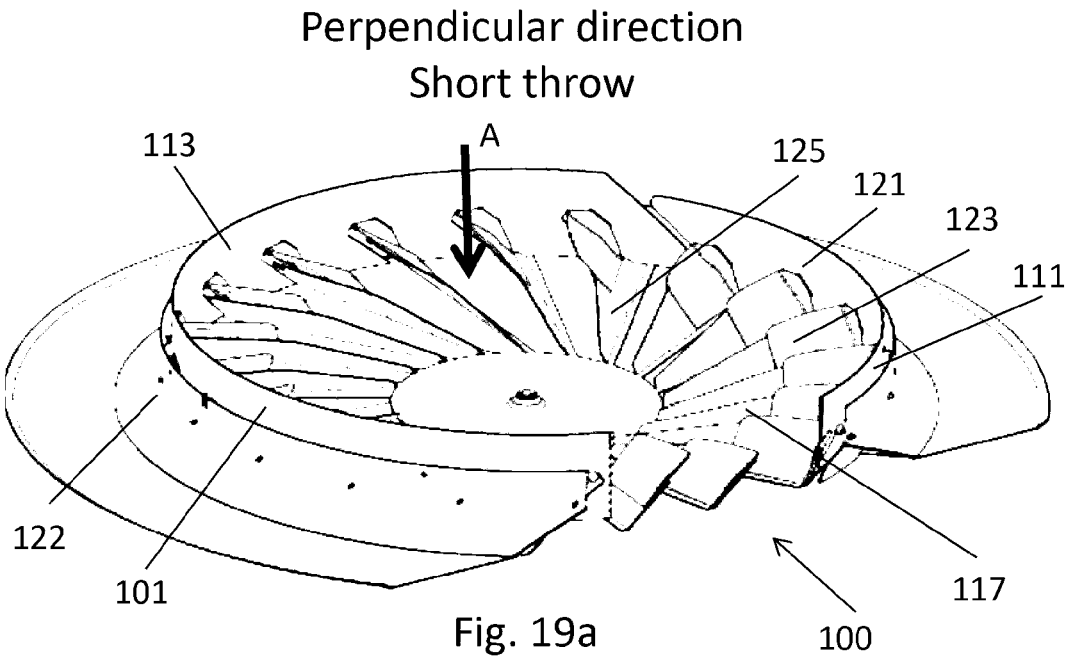
FIG. 19*a-b* shows a perspective view (a) and a cross section (b) through the embodiment of the diffuser shown in FIG. 15 whereby the direction adjustment guide ring segment is in the advanced position and the throw adjustment guide ring segment is in the retracted position.
Figure 19B:
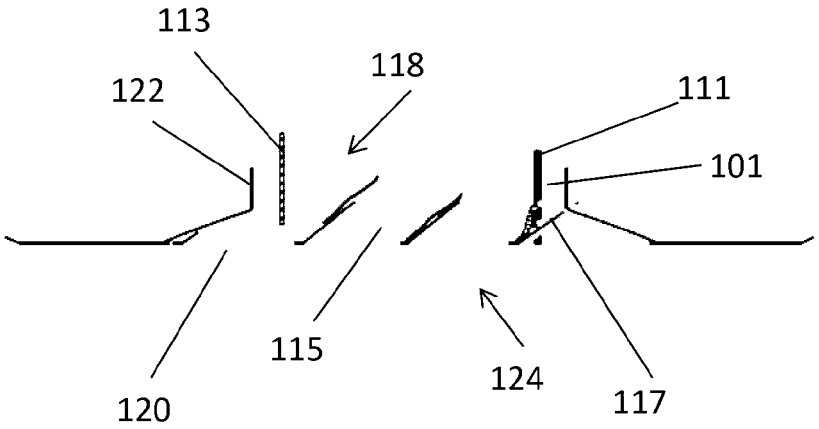

FIG. 19*a* shows the diffuser 100 with the direction adjustment guide ring segment 111 in the advanced position and the throw adjustment guide ring segment 113 in the retracted position. FIG. 19*b* shows a cross section through the diffuser for FIG. 19*a*.

When the direction adjustment ring segment 111 is in the advanced position and the throw adjustment ring segment 113 is in the retracted position, the supply air is discharged with relatively short throw in a direction that is substantially perpendicular to the diffuser face. The resultant discharge of the diffuser is substantially perpendicular to the face of the diffuser face with short throw (see airflow pattern 110*d* shown in FIG. 21*b*).

The discharge direction of the supply air stream can be altered by retracting and advancing the direction adjustment ring segment 111. For example, in a side blow application, the first guide ring segment 111 would typically be retracted to direct the air towards the floor in heating applications (e.g. FIGS. 18*a-b*) and advanced to direct air with less downward inclination or substantially parallel to the floor in cooling applications (e.g. FIGS. 21*a-b*).

Figure 20A:
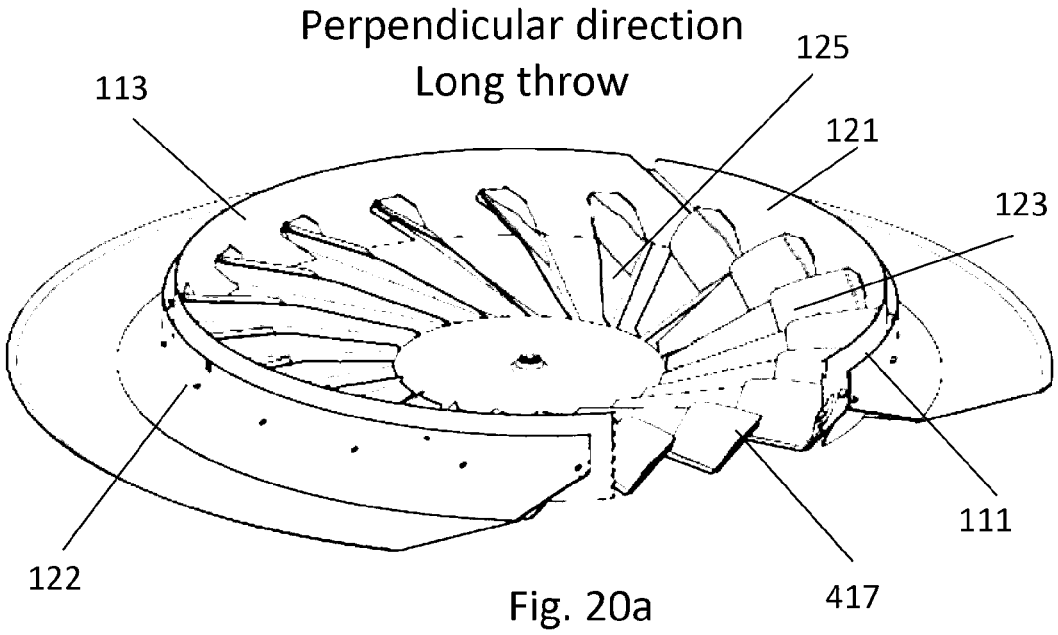
FIG. 20*a-b* shows a perspective view (a) and a cross section (b) through the embodiment of the diffuser shown in FIG. 15 whereby the direction adjustment guide ring segment is in the advanced position and the throw adjustment guide ring segment is in the advanced position.
Figure 20B:
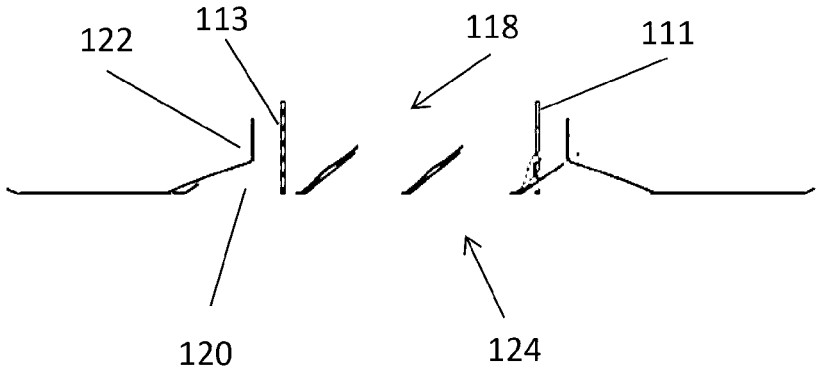
Figure 21A:
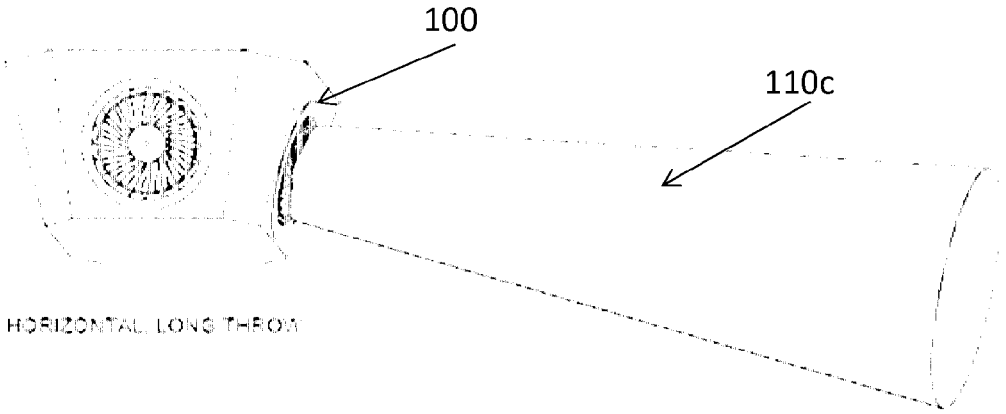
FIGS. 21*a-b* show a view of the supply air pattern for the diffuser disclosed with reference to FIG. 19 (*b*) and FIG. 20 (*a*)
Figure 21B:
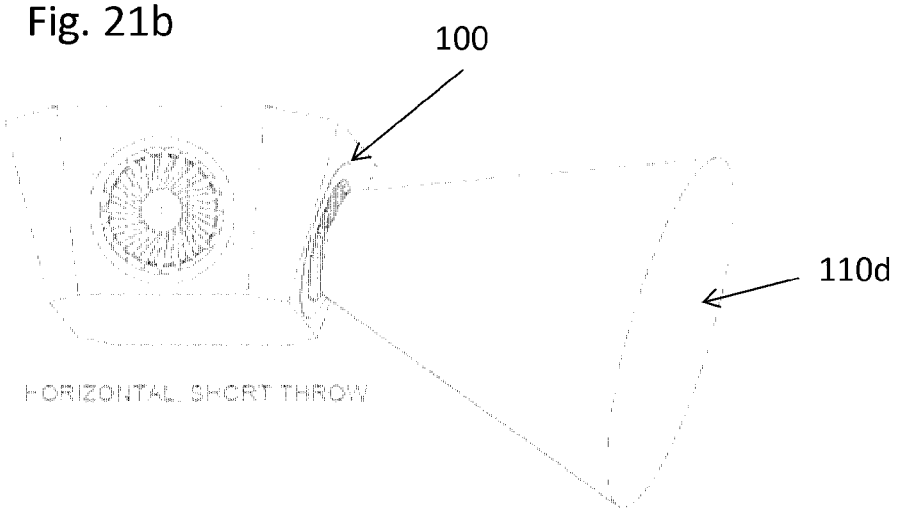
Figure 22A:
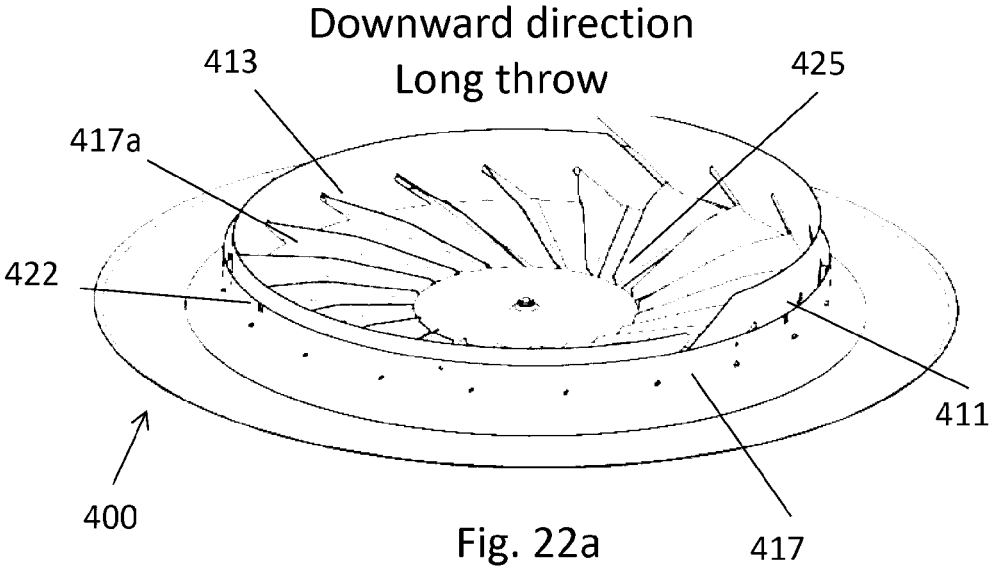
FIG. 22*a-b* shows a perspective view (a) and a cross section (b) through an embodiment of the diffuser having independent throw and direction adjustment ring sectors.
Figure 22B:
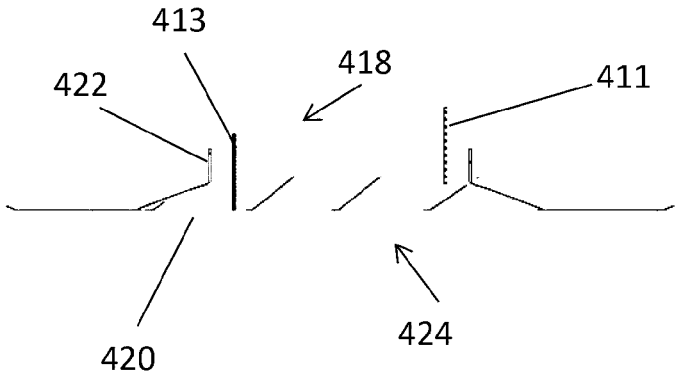

FIG. 20*a* show both the direction 111 and throw 113 guide ring segments in the advanced position. FIG. 20*b* shows a cross section through the diffuser of FIG. 20*a*. The resultant discharge direction of the diffuser is substantially perpendicular to the diffuser face (as shown in FIG. 21*a*). In the advanced position, the throw guide ring segment 113 effectively reduces the cross-sectional area of the diffuser face and the spread of the discharged air by cutting off the airflow at the periphery of the diffuser from discharging through flared exit 120. Simultaneously, in the advanced position, the respective guide vanes 123 are retracted, thereby reducing the width of the respective channels 115, and hence reducing the inclination of the discharged air. As such, for a given airflow rate, the spread of the discharged swirling airstream is reduced, thereby concentrating the airstream, which therefore has an increased throw (FIG. 21*a*) relative to the position shown in FIG. 21*b* (i.e. when throw adjustment guide ring segment 113 is in the retracted position).

As previously mentioned, in another alternative embodiment the direction and throw adjustment rings can be independent rings of varying radius. In addition, alternative embodiments of the diffuser include direction and throw guide ring segments having different radii. Further, some embodiments of the diffuser include guide vanes on the outer wall of the guide ring in lieu of the inner wall. Also, some embodiments of the diffuser include one or more baffles, which may be in the form of a perforated plate in the neck of the diffuser, to restrict airflow to at least some of the channels 415 that discharge the throw control air stream. FIGS. 22-28 show some of the alternative embodiments of the diffuser (400, 500, 600, 800 & 900).

In another form, shown in FIG. 16*a-b*, neither the direction adjustment ring segment 411 nor the throw adjustment ring segment 413 include projecting guide vanes (i.e. vanes 12 shown in FIGS. 10-15). FIG. 16*a* shows the direction guide ring segment 411 in the retracted position and the throw guide ring segment 413 in the advanced position, thus producing a supply air pattern that is inclined relative to the diffuser central axis with long throw.

Figure 23:
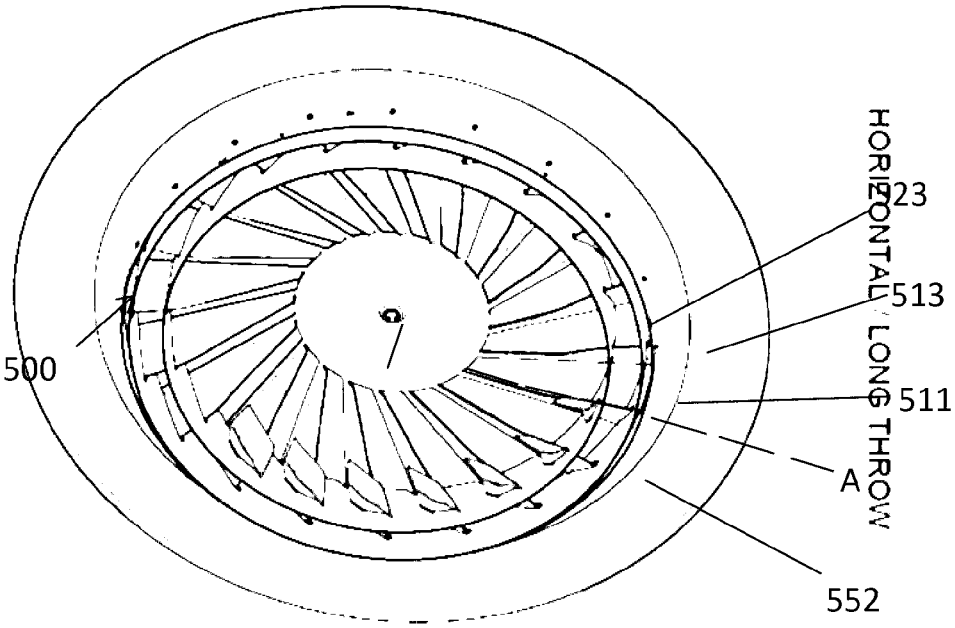
FIG. 23 shows a side perspective view through an embodiment of the diffuser having independent throw and direction adjustment rings and guide vanes connected to the direction adjustment ring.
Figure 24:
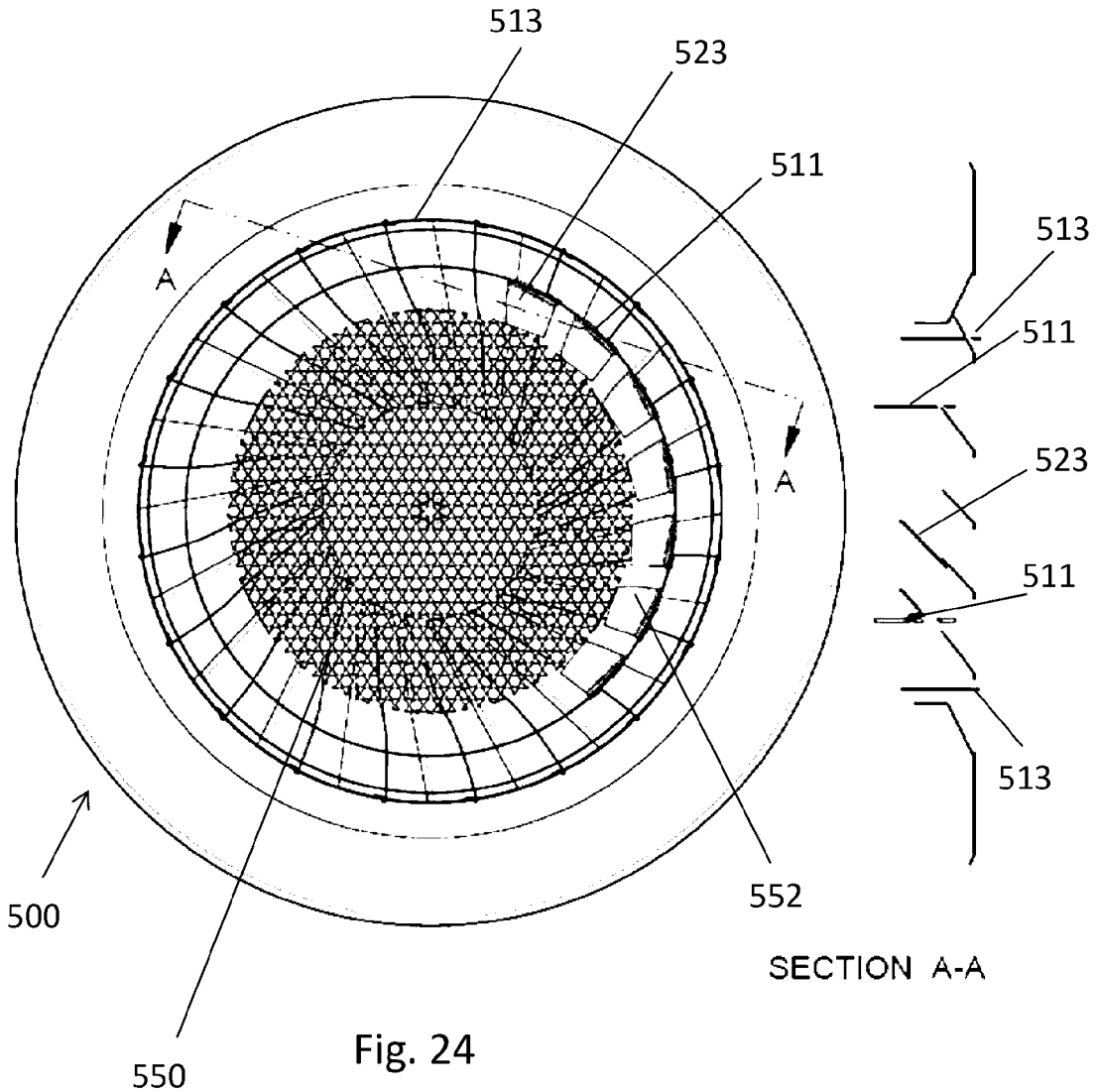
FIG. 24*a-b* shows a rear view (a) and a cross section (b) through a further embodiment of the diffuser shown in FIG. 23.

In FIGS. 23 & 24, the direction adjustment ring 511 has a smaller radius than the throw adjustment ring 513. Both the direction adjustment ring 511 and throw adjustment ring 513 translate along the central axis A of the diffuser between the advanced and retracted positions. Translation of the direction adjustment ring 511 varies the discharge direction of the supply air. Translation of the throw adjustment ring 513 varies the throw of the supply air. In the embodiment shown in FIGS. 23 & 24, the direction adjustment ring 511 includes, in a sector, guide vanes 523 that are similar to those described in relation to FIGS. 14 & 15; these assist to direct air at an acute angle relative to the central axis A of the diffuser.

An advantage of this embodiment is that the throw adjustment guide ring 523 is positioned about the full circumference of the diffuser face (i.e. not a sector of the circumference of the diffuser face). Thus, adjustment of the throw adjustment guide ring 523 does not impact (i.e. bias) the discharge direction of the supplied airstream. Also, the range of throw achievable is greater (i.e. the maximum thrown and minimum throw achievable is more and less respectively relative to the embodiment of the diffuser that includes ring sectors). Further, the diffuser 500 may also include a perforated plate 550 (shown in FIG. 24). The perforated plate advantageously assists to throttle a portion of the airflow, thereby reducing the velocity of the airflow through the channels of the diffuser that are positioned adjacent to (i.e. lie directly downstream of) the perforated plate 550. The positioning of the perforate plate 550 increases the momentum of the remaining portion of the airflow, which includes—or may be restricted to—the discharge direction adjustment airstream, thereby increasing the dominance of the discharge direction adjustment airstream on the combined airstream so as to increase the effectiveness of altering discharge direction of the combined airstream by means of altering the discharge direction airstream. Importantly, the perforated plate 550 is positioned away from the first discharging arrangement (i.e. the mechanism of the diffuser that controls the discharge direction of the airflow). In the embodiment of the diffuser 500 shown in FIGS. 23-24, the first discharge arrangement is the portion 552 of the discharge direction guide ring 513 that includes the guide vanes 523. Thus, the airflow that passes through the first discharge arrangement and through the channels of the diffuser positioned directly downstream dominate and thereby induce the surrounding airstream to control the direction of the discharged supply airstream.

Figure 25:
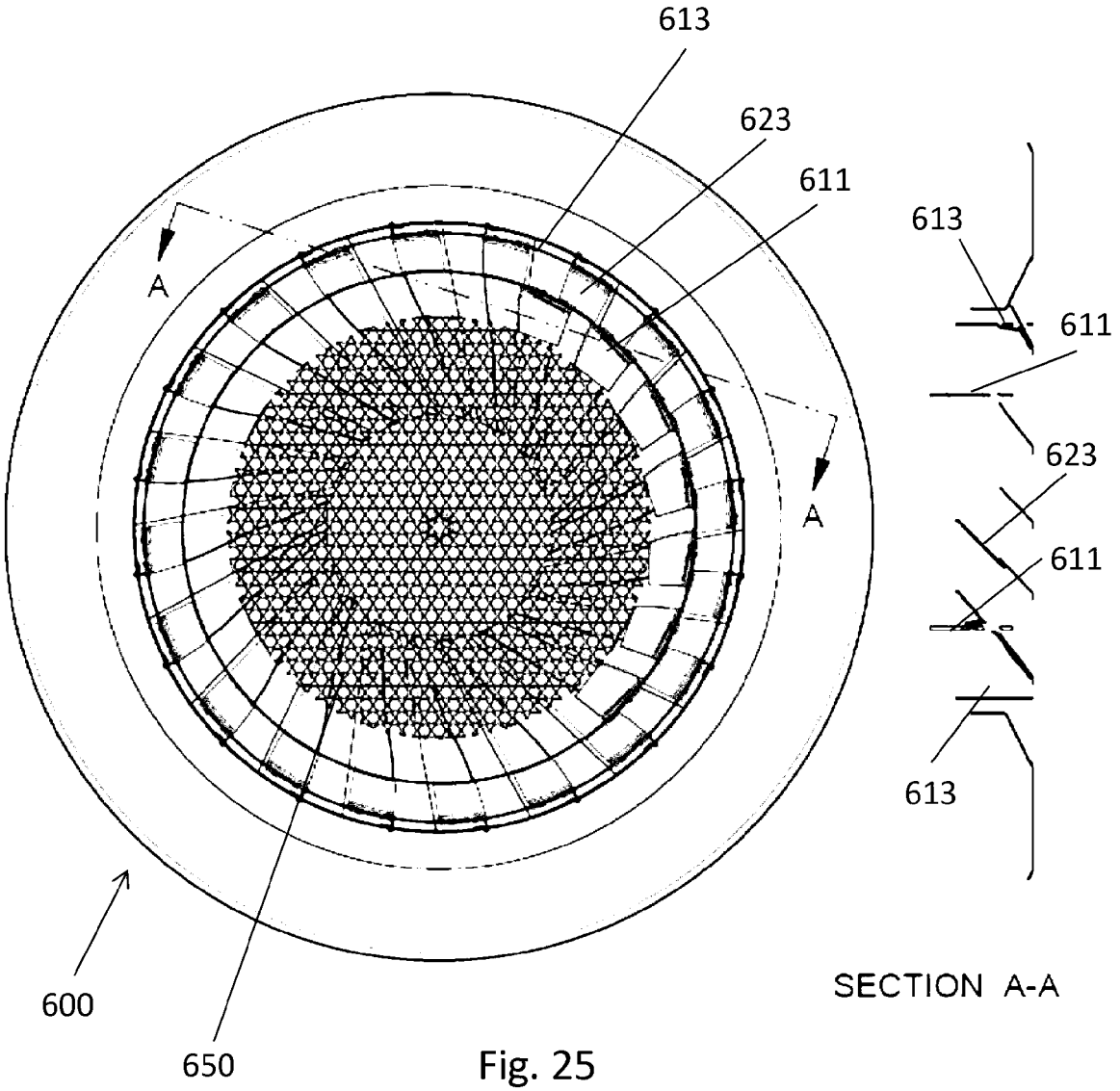
FIG. 25*a-b* shows a rear view (a) and a cross section (b) through an embodiment of the diffuser having independent throw and direction adjustment rings and guide vanes connected to both rings.

FIG. 25 shows a diffuser 600 having a direction adjustment ring 611 with a smaller radius than the throw adjustment ring 613. Both the direction adjustment ring 611 and throw adjustment ring 613 translate along the central axis of the diffuser between the advanced and retracted positions. Translation of the direction adjustment ring 611 varies the discharge direction of the supply air. Translation of the throw adjustment ring 613 varies the throw of the supply air. In the embodiment shown in FIG. 19, the direction adjustment ring 611 includes, in a sector, guide vanes 623 that are similar to those described in relation to FIGS. 14 & 15; these assist to direct air at an acute angle relative to the central axis of the diffuser. In this embodiment, the throw adjustment guide ring 613 also includes guide vanes 623 disposed about the internal circumference of the ring. Similar to the embodiment disclosed in FIGS. 23 & 24, the diffuser 600 also includes a perforated plate 650.

Figure 26:
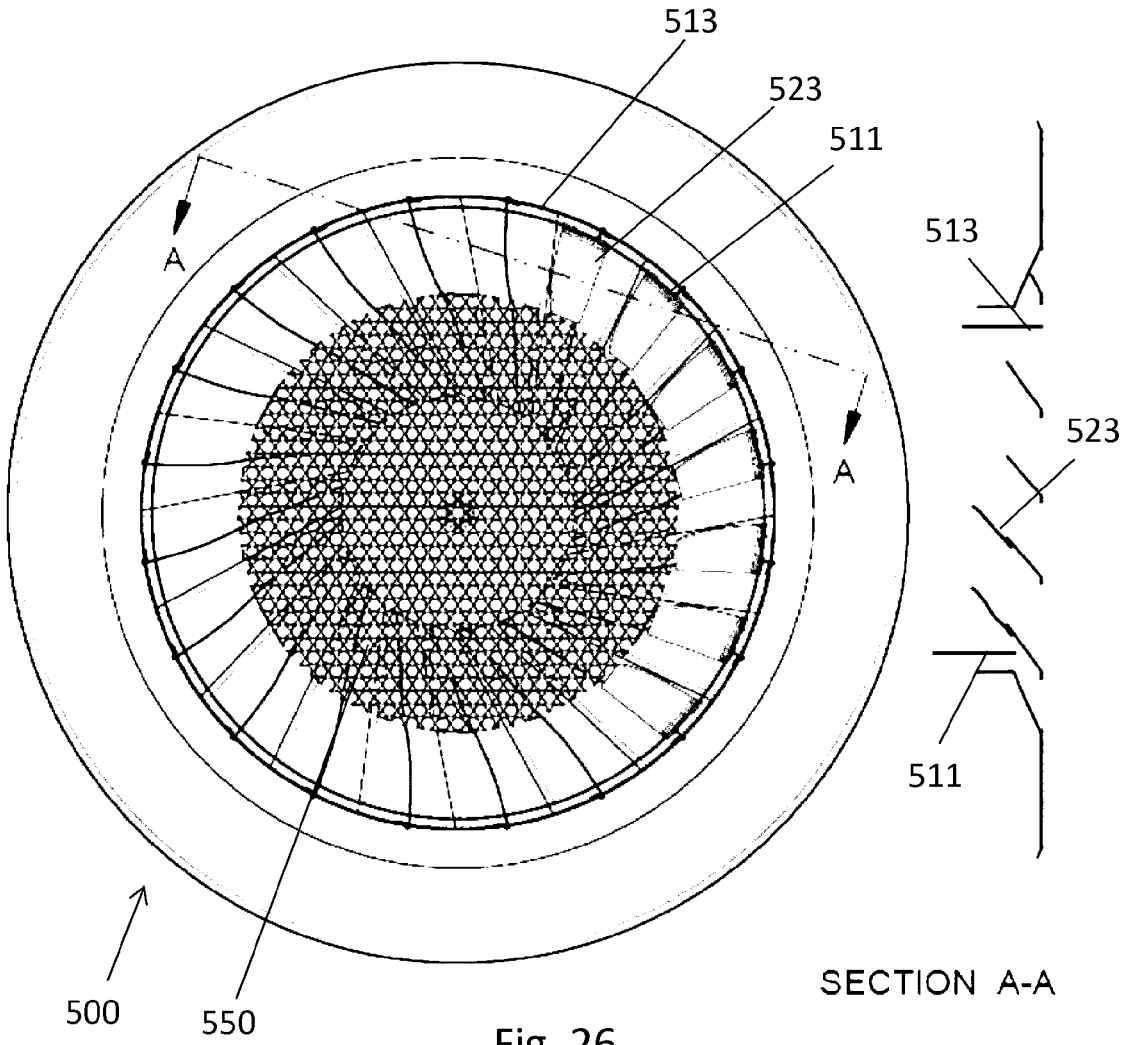
FIG. 26*a-b* shows a rear view (a) and a cross section (b) through an embodiment of the diffuser having throw and direction adjustment ring segments and guide vanes connected to the direction adjustment ring segment.

FIG. 26 shows a further embodiment of the diffuser of FIGS. 23 & 24. The diffuser 500 also includes a perforated plate 550 positioned within the neck of the diffuser.

Figure 27:
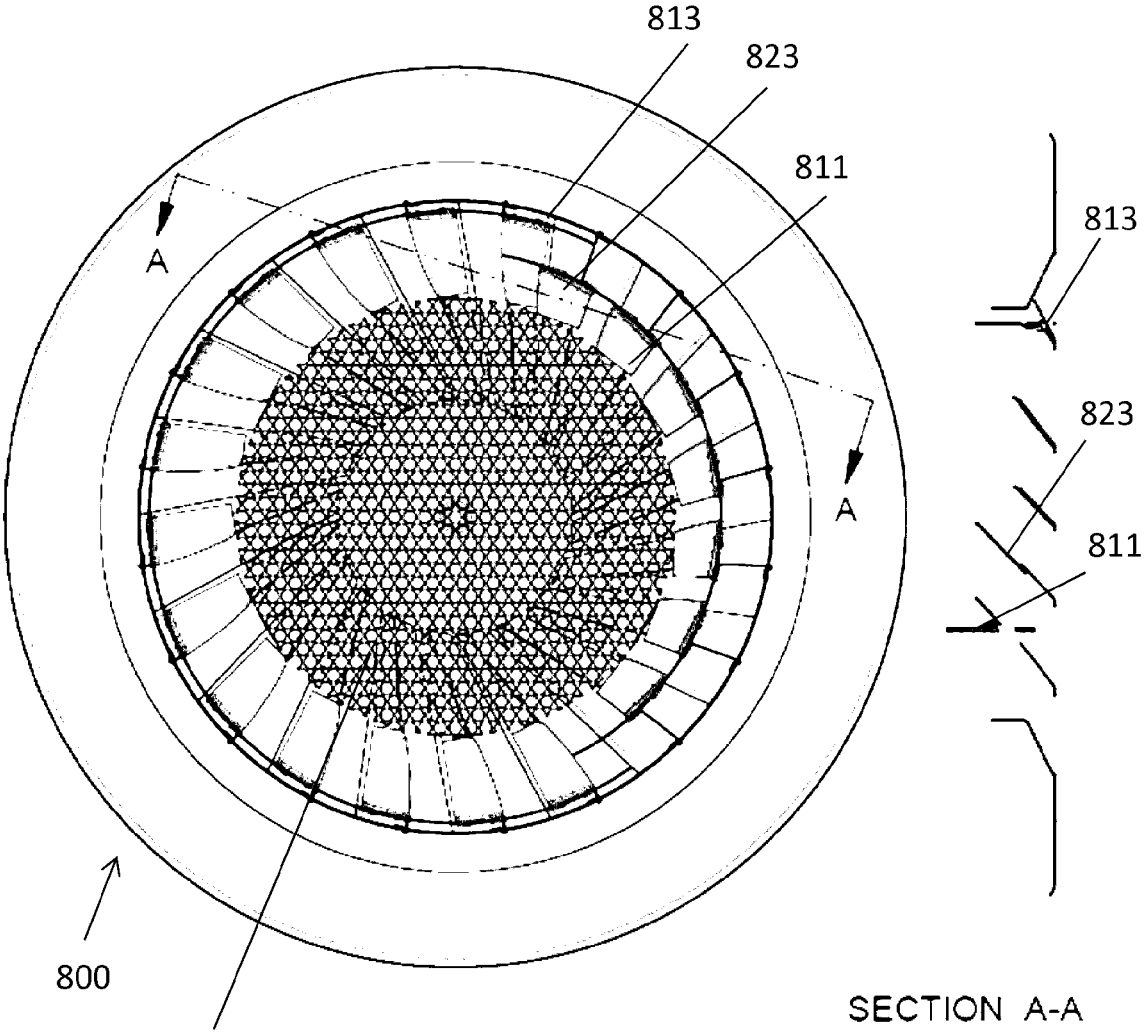
FIG. 27*a-b* shows a rear view (a) and a cross section (b) through an embodiment of the diffuser having throw and direction adjustment ring segments of differing radius and guide vanes connected to the direction adjustment ring segment.

FIG. 27 shows a diffuser 800 having a direction adjustment ring segment 811 with a smaller radius than the throw adjustment ring segment 813. In this embodiment, both the direction adjustment ring segment 811 and the throw adjustment ring segment 813 include guide vanes 823 and the diffuser 800 includes a perforated plate 850 in the neck of the diffuser 800.

Figure 28:
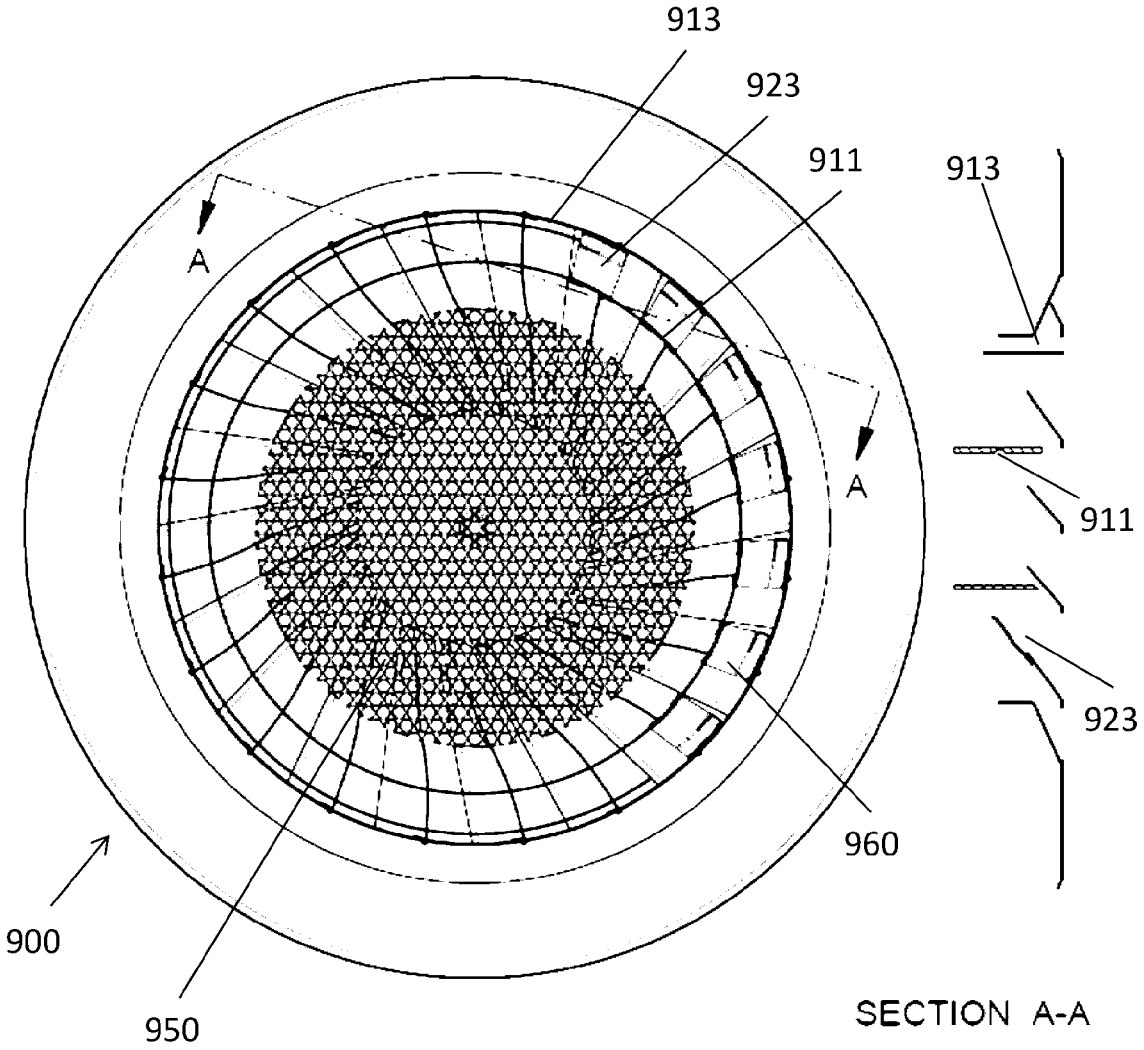
FIG. 28*a-b* shows a rear view (a) and a cross section (b) through an embodiment of the diffuser having independent throw and direction adjustment rings of differing radius and guide vanes connected to the outside wall of a segment of the direction adjustment ring.
Figure 28:
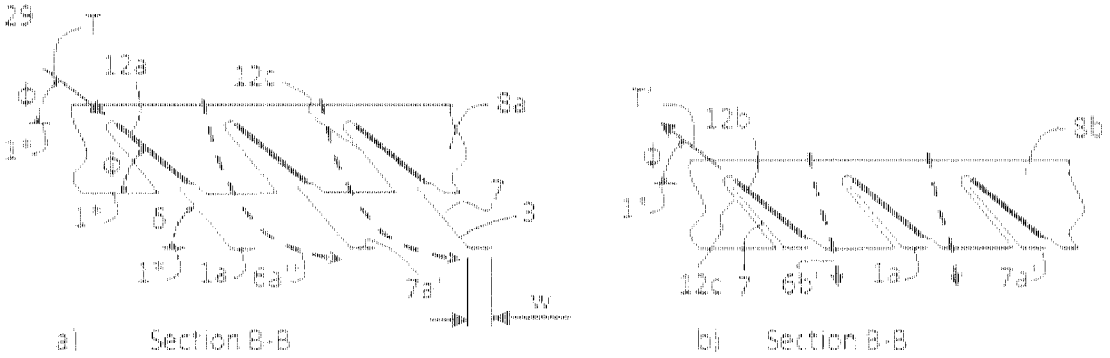

FIG. 28 shows a diffuser 900 having a direction adjustment ring 911 with a smaller radius than the throw adjustment ring 913. In this embodiment, the direction adjustment ring 911 includes guide vanes 823 disposed about the external wall 960 of the direction adjustment ring 911 and the diffuser 900 includes a perforated plate 950 in the neck of the diffuser 900.

An air delivery system incorporating the diffuser described herein provides the potential for substantial energy savings and more effective performance, as well as for improved thermal comfort, discharge direction control, reduced capital cost and enhanced aesthetics.

HVAC systems that deliver supply air to spaces via diffusers with vanes that include at least a portion of geometric twist of constant helical pitch, in accordance with the disclosure, may offer lower pressure drop and may be designed to operate with variable speed drive fans or variable air volume (VAV) systems, including ones operating with low temperature supply air in which the supply-to-room temperature differential is as great as −16 K, to reduce airflow during periods of low thermal load, thereby saving fan energy, as a diffuser as described by the disclosure, when configured to discharge air largely horizontally, can have the supply air turned down as low as 25% (from a total operating pressure of 35 Pa including the pressure drop of a side-entry connection box), which is a far lower airflow rate than is typical of the prior art, whilst maintaining stable and largely horizontal discharge. This provides substantial potential for increased fan energy savings. Additionally, the maximum airflow rate that may be discharged by a diffuser as described by some embodiments of the disclosure is greater than that of a comparable diffuser of the prior art, thereby potentially allowing a smaller number of diffusers to be used, or a smaller diffuser face size to be selected, hence reducing capital costs and improving aesthetics.

Embodiments of the disclosure allow the diffuser to provide discharge direction adjustment that improves occupancy zone air temperature control, increases heating efficiency, and reduces uncontrolled airflow rate fluctuations due to system supply air pressure changes, thereby improving both occupant comfort and system efficiency. The stable discharge direction adjustment and ability to modulate the discharge direction pattern between substantially parallel and substantially perpendicular to the diffuser face plane allow fine tuning of the air pattern to the requirements of the space. Substantially constant pressure drop across the range of discharge direction adjustment maintains substantially constant airflow rates across each diffuser and prevents fan surging, benefiting stable zone temperature control and efficient operation.

Embodiments of the disclosure have a substantially flush diffuser face and vanes, with the number of vanes being 20 or more. Furthermore, the diffuser face may be substantially flush mounted to a solid ceiling without compromising discharge direction adjustment of the discharged air stream. This provides a visually appealing aesthetic with substantially flush surfaces and minimal gap sizes between vanes.

The fixed discharge and adjustable discharge embodiments of the disclosure share common manufacturing processes, such as the tools to stamp the vanes, thereby saving on tooling and manufacturing costs.

The fixed discharge and adjustable discharge embodiments of the disclosure have a similar aesthetic, thereby allowing both to be used within the same or visually linked spaces without clashing visually.

Embodiments of the disclosed diffuser provide a compact design. The diffuser depth (intake to discharge face dimension measured along the diffuser central axis) may be small. This compact design allows for installation in restricted spaces. It may also reduce the cost of the diffuser by reducing storage, shipping and fabrication costs.

It should be noted that the embodiment described with respect to FIGS. 16-28 can be used as a side-blow diffuser design and may be a variation of a ceiling diffuser design. This reduces fabrication costs due to economies of scale, shared components and mechanisms, and common tooling shared with the ceiling diffuser variants. Further, large range of diffuser sizes available: The side-blow diffuser design may be a variation of a ceiling diffuser design, which may be available in five nominal neck diameters, viz. 250 mm, 355 mm, 500 mm, 710 mm and 1000 mm. Shared tooling, components and mechanisms expands the range of neck sizes for which the side-blow diffuser is commercially viable and hence available, broadening the range of applications for which it may be used, which can range from small spaces with small airflow rates of approximately 250 L/s per diffuser and horizontal throws of approximately 10 m, to extremely large spaces requiring large airflow rates of approximately 4000 L/s per diffuser and horizontal throws of approximately 40 m.

Providing the ability to use the design in both side wall and ceiling arrangements allows for a shared aesthetic between the side wall and ceiling diffuser variants. By being of similar design, and hence styling, to the ceiling diffuser variant with which it shares tooling, components and mechanisms, the side-blow diffuser is of matching design and may therefore be used within the same space without clashing visually with the ceiling diffusers. This is architecturally desirable.

As the side-blow diffuser is a swirl diffuser, its highly inductive discharge rapidly breaks down the velocity of the discharged airstream, strongly diluting this with induced room air, thereby simultaneously increasing the mass flow rate of the supply airstream. The supply air stream, therefore, has a high mass flow rate, which is able to traverse long throws, and travels at low velocity, which is also suitable for short throws and for draught-free air motion in the space. The side-blow diffuser is, therefore, suitable for a wide range of applications, including long and short throws, as well ones where draught-free air motion is required (both for comfort and to prevent lighting or signage from swinging in the breeze). The strong dilution of the discharge air with room air also substantially equalises the supply air stream temperature with room temperature, realising substantially uniform temperature distribution in the space. These factors improve overall temperature distribution, comfort levels, operational efficiency and the range of spaces in which the diffuser may be used. They also allow larger diffusers to be used, each discharging a larger airflow rate, than would otherwise be possible with non-swirl discharge. This has the potential to reduce overall building costs.

The mechanism that both translates and rotates the discharge direction mechanism for the side-blow diffuser described herein may be shared with the discharge direction mechanism used for the ceiling swirl diffuser. This reduces the cost of equipping the diffuser with discharge direction adjustment, especially where such adjustment is thermally or electrically activated.

Advantageously, embodiments of the diffuser provide relatively neutral pressure loss throughout the discharge direction adjustment range. This may be important for diffusers that are part of a ducted system or common plenum, as neutral pressure characteristics across the discharge direction adjustment range will ensure that discharge direction adjustment will not affect the air balancing of the system, especially where direction adjustment is changed seasonally, or is automated via thermal or electric actuators.

Throw adjustment with guide vanes attached to a guide ring that does not extend to obstruct flared exit when in the engaged position may increase pressure drop for short throws. This is advantageous for multiple diffusers connected to the same duct system or plenum, as diffusers set for longer throws therefore supply a greater airflow, which is appropriate given that they serve a larger floor area.

FIGS. 29*a-b* show side sectional views of an embodiment of the ceiling swirl diffuser that is similar to that shown in FIG. 5*b*, in which the supply air stream 5 flows into the neck 4 of the diffuser and onto the substantially radially aligned swirl vanes 7. The air is discharged from the diffuser face 1*a* as a swirling air stream that is directed substantially parallel to diffuser face 1*a*.

An adjustable guide ring, which may be raised 8*a* or lowered 8*b* by an adjustment mechanism (not shown), has guide vanes 12*a-b* fixedly attached to it. The guide vanes are raised 12*a* (position as shown in FIG. 29*a*) or lowered 12*b* (position as shown in FIG. 29*b*) as the guide ring is adjusted between the raised and lowered positions. The raised and lowered positions are relative to a guide ring plane 1* that is parallel to the diffuser face 1*a*. This movement of the guide ring alters the swirl discharge direction from substantially parallel 6*a*" (see FIG. 29*a*) to substantially perpendicular 6*b*' or approaching perpendicular (see FIG. 29*b*) to the diffuser face, respectively. In this embodiment, the paths of travel (represented by arrows T and T') of the guide vanes 12*a-b* between the guide ring raised 8*a* and guide ring lowered 8*b* positions are at an acute angle (represented by φ in FIGS. 29*a-b*) relative to guide ring plane 1*. Swirl vanes 7 are also at acute angle (represented by δ in FIGS. 29*a-b*) relative to guide ring plane 1*. Angle φ is less, generally by approximately 5°, than angle δ. The guide ring 8*a-b* includes guide slots 12*b*, each fashioned to slot around corresponding swirl vane 7 when the guide ring is lowered 8*b*. The guide slots in this embodiment are relatively wide at their opening (towards the diffuser face) and relatively narrow at their closure (away from the diffuser face) to accommodate the difference in angle between the swirl vanes 7 and the guide vanes 12*a-b*.

In comparison to the embodiment shown in FIGS. 5*c* and 5*d*, the embodiment shown in FIGS. 29*a-b* may provide one or more of the following advantages:

1. Swirl vane trailing edge 7*a*' may have an increased width w relative to that of the embodiment shown in FIGS. 5*c* and 5*d*, generally by approximately 20%, thereby providing stronger deflection of the discharge direction of air to substantially parallel 6*a*" to guide ring plane 1* when the guide ring is in the raised position 8*a*. This allows the maximum supply-to-room temperature differential in cooling mode to be increased and/or the minimum airflow rate in cooling mode to be decreased whilst maintaining stability of the substantially parallel 6*a*" discharge pattern. This is advantageous in preventing diffuser dumping at low airflow rates, such as in noise sensitive or VAV applications. Also, fan energy savings may be achieved by reducing fan speed during cooling mode; and
2. A stronger perpendicular discharge direction 6*b*' of air may be achieved when the guide ring is in the lowered position 8*b* as the guide vane 12*b* substantially directs airflow 6*b*' away from swirl vane trailing edge 7*a*', thereby reducing the degree to which the airflow is deflected by swirl vane trailing edge 7*a*' towards guide vane plane 1*. This allows the maximum permissible heating supply-to-room temperature differential to be increased and/or the supply air rate required at a given heating supply-to-room temperature differential to achieve penetration of the warm supply air down to floor level to be decreased, thereby achieving improved heating effectiveness and/or fan energy savings, respectively; and
3. Swirl blade angle δ may be steeper than in the embodiment shown in FIGS. 5*c* and 5*d*, generally by approximately 5° (to achieve a peripheral swirl vane angle δ of approximately 43°), thereby reducing the airflow pressure drop. This may save fan energy and reduce the diffuser noise level.

Not shown are guide ring positions between those depicted in FIGS. 29*a-b*, which allow discharge direction to be modulated between substantially parallel 6*a*" and substantially perpendicular 6*b*'. Also not shown is the range of vane geometric twist 19 in FIGS. 7*a-b* and 8*a-b* located towards the periphery of the substantially radial vanes 7 so as to provide a shallow vane angle adjacent to bell mouth 2 to facilitate the attachment of the airflow of discharged swirl airstream 6*a*" to the face 1*a*, thereby providing an increasing vane angle relative to diffuser face 1*a* and of equal helical pitch (P) closer to central axis (I), and thereby increasing the amount of air that may be discharged by the diffuser (S1).

Figure 30:
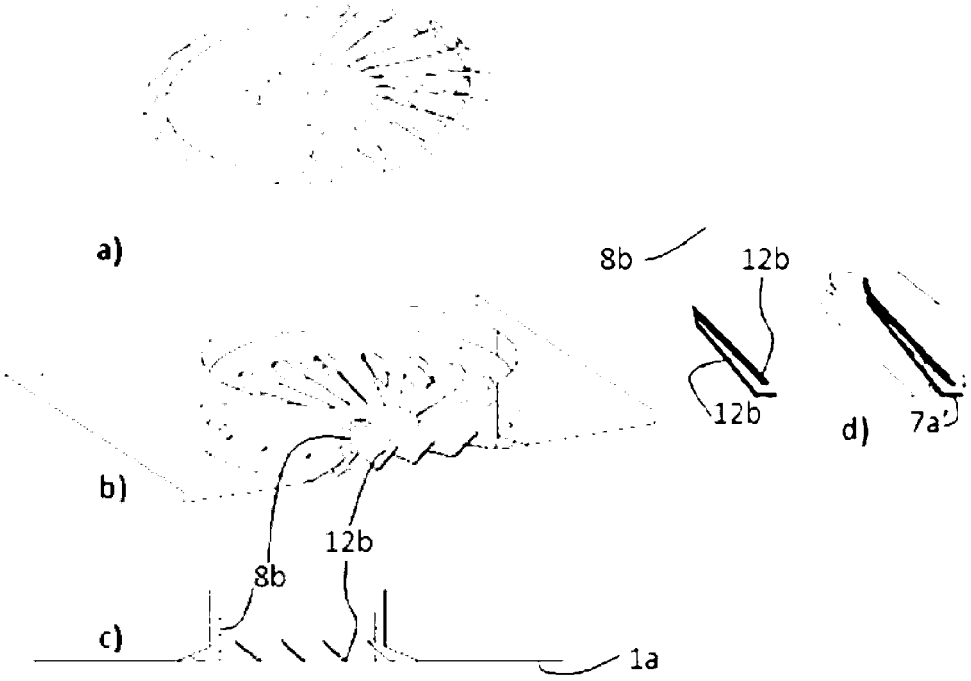
FIG. 30*a-c* show views of the embodiment of the diffuser shown in FIG. 29*a;*
Figure 31:
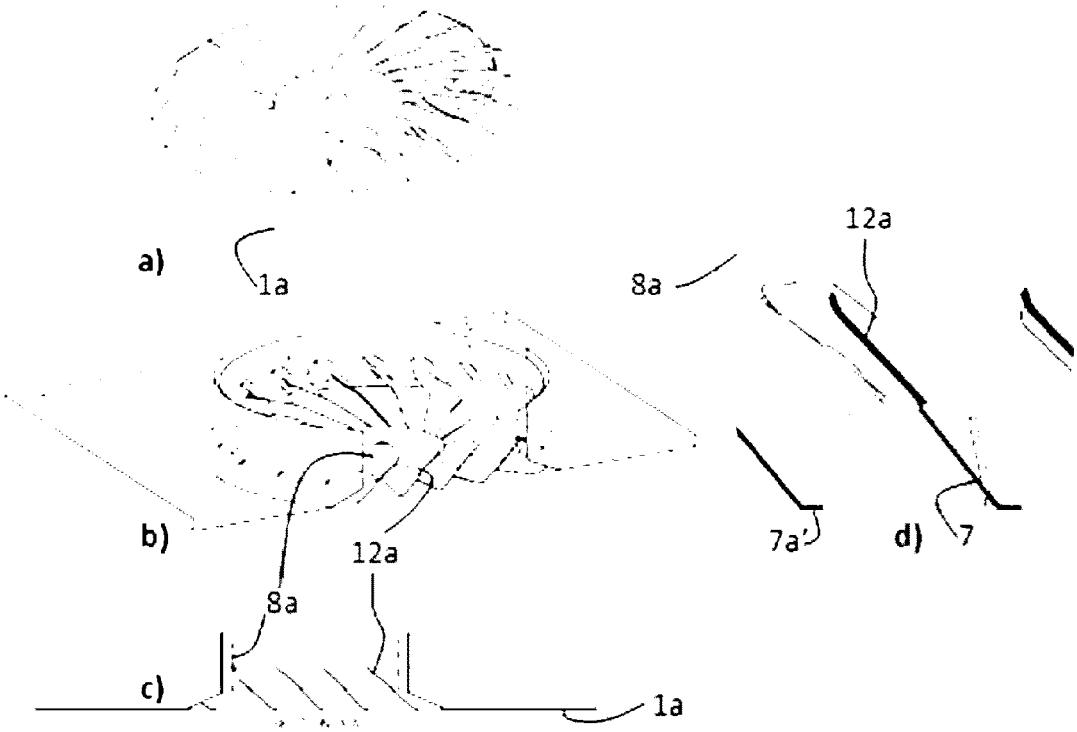
FIG. 31*a-c* show views of the embodiment of the diffuser shown in FIG. 29*b;*

FIGS. 30*a-c* show views of an embodiment of the diffuser shown in FIG. 29*a*. FIGS. 31*a-c* show views of an embodiment of the diffuser shown in FIG. 29*b*.

FIGS. 32*a-b* show an embodiment of a swirl diffuser whereby filtered and conditioned supply air 5 discharged by swirl vanes 7 as swirling air stream 6 induces room air Ra to flow along diffuser hub 1*b*. Room air Ra often has higher moisture content relative to the supply air 5. Also, room air Ra usually contains dirt particles, especially of organic origins (dead skin cells in particular). The relatively high moisture content and presence of dirt particles in the room air Ra can lead to the formation of condensation on surfaces of the diffuser 1 during cooling mode and/or to "smudging". Smudging is the deposit of dirt on surfaces of diffuser 1. Condensation occurs and/or dirt is deposited on the diffuser surfaces that the induced room air Ra comes into contact with which, in particular, is in or adjacent to the regions of strongest induction, such as the peripheral portions of the diffuser hub 1*b* and along or adjacent to diffuser trailing edges 7*a*', close to the diffuser hub 1*b*. Swirl diffusers are particularly afflicted by this problem, as swirl diffusers are characterised by especially high rates of induction of room air Ra. Smudging is unsightly, is difficult to clean due to diffusers typically being located at a high level—out of arm's reach—and increases maintenance costs of the building. Diffuser smudging is not only visually unappealing, but is unhygienic. Avoiding smudging may be particularly important in health care and restaurant facilities, where dirty diffusers may create the impression of uncleanliness, especially as the appearance of smudge marks on the diffuser face often causes building occupants to believe that the air conditioning or ventilation system is supplying dirty air and that the establishment is dirty. This causes complaints about the air conditioning system, and creates a negative psychological impact on occupants due to the perception that they are visiting, working, are receiving medical treatment in, or are eating in a building that not only has poor indoor air quality but is dirty, which may lead to lower worker morale and reduced productivity, as well as reduced customer patronage or increased perception of illness and poor health.

The room air Ra in the air conditioned or ventilated space often has a high moisture content, such as in applications with dense occupancy (breathing releases water vapour) and in many spaces with high levels of infiltration of moist outdoor air, such as in the tropics. Under these circumstances, if the supply air temperature is lower than that of the room air Ra then the diffuser face temperature may drop below the dew point temperature of the room air Ra. This results in condensation occurring on those surfaces of the diffuser 1*a* that the room air Ra comes into contact with, such as the hub 1*b* of the diffuser and the low pressure regions of the diffuser vanes (typically portions of the trailing edges 7*a*' closest to the hub). The lower the supply air temperature the greater the condensation threat, and the higher the room air moisture content the greater the condensation threat.

Swirl diffusers are a particularly effective diffuser for the supply of air at lower than normal supply air temperatures, as the particularly high induction ratios achieved by swirl diffusers strongly dilute the supply air with room air, thereby preventing dumping into the space and reducing the threat of draughts. Low supply air temperature systems are increasing in popularity due to the increased fan energy savings that they achieve, as lower air quantities are required with low temperature supply air systems than with conventional air conditioning systems. Swirl diffusers are, therefore, increasingly becoming prone to condensation issues, especially as the popularity of low supply air temperature systems spreads to the tropics. Condensation on the diffuser surface is unsightly and is unhygienic, as it may lead to the formation of mould or fungus on the diffuser. The growth of mould and fungus may be exacerbated by "smudging"—by the deposit of dirt onto these very same regions of the diffuser—as this dirt usually contains organic material. Organic material plus condensation (i.e. water) feed the mould and fungus. Mould and fungus spores are well-known causes of "sick building syndrome", which refers to buildings that are characterised by unusually high absenteeism rates due to occupant illness or lack of wellbeing. As human resources are usually the biggest expense by far for most companies, avoiding sick building syndrome is of particular concern to many building owners and tenants. Condensation may also lead to premature ageing of the diffusers, in particular to the formation of rust on the diffusers, and it may lead to water droplets falling from the ceiling, causing not only a potential slip hazard but also requiring periodic mopping of the floor or even the installation of drainage, especially in tropical regions.

Figure 32:
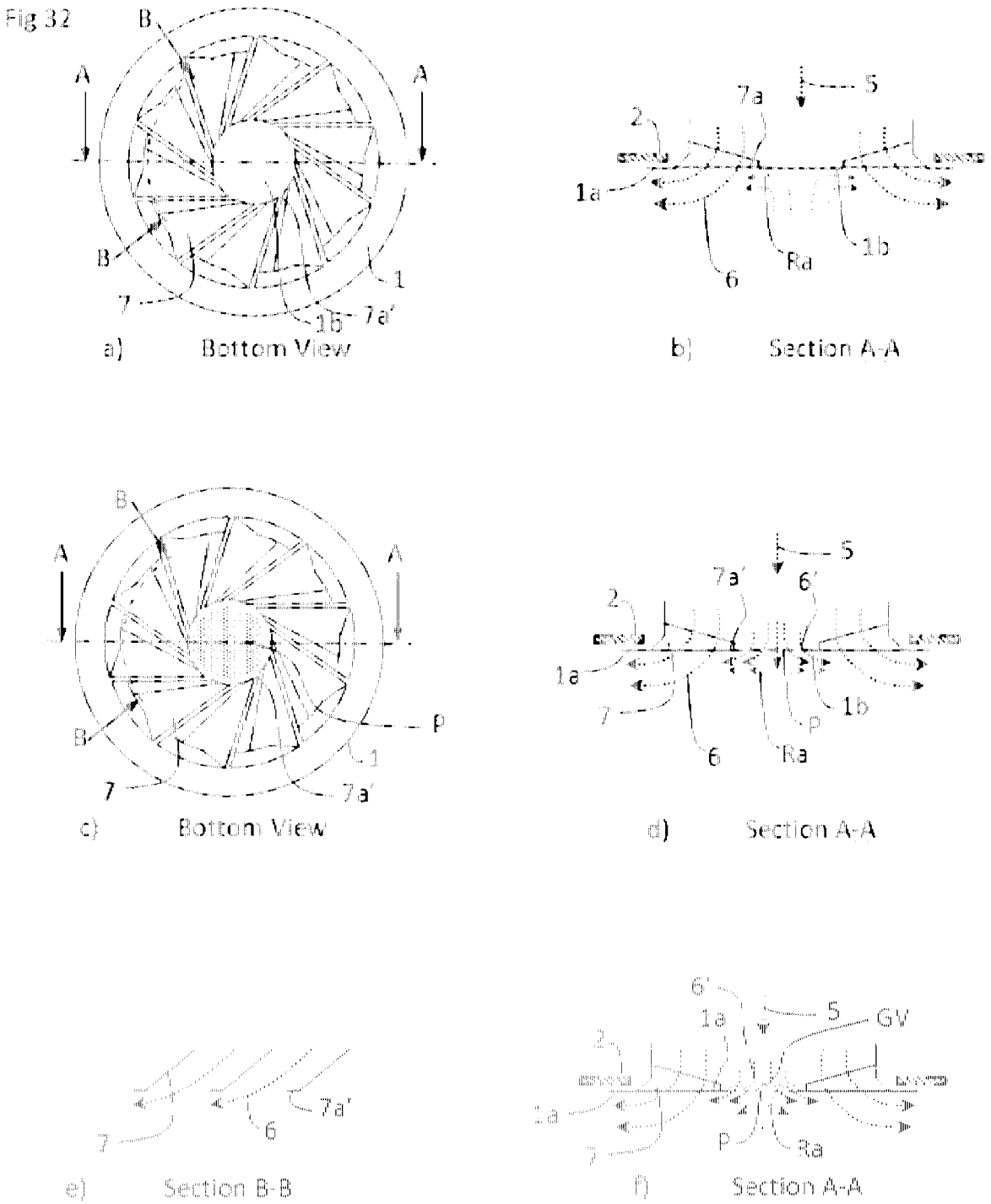
FIG. 32*a-b* show a bottom view (a) and a side sectional view (b) of a prior art swirl diffuser.
FIG. 32*c-f* show a bottom view (c), a side sectional views (d-f) of an embodiment of a swirl diffuser having a perforated central hub.

FIGS. 32*c-e* show another embodiment of a swirl diffuser whereby the hub 1*b* incorporates a perforated portion P through which a portion of supply air 5 is discharged as screen air stream 6'. The diffuser may be similar to the diffusers detailed with respect to FIGS. 1 to 32*a-b*. Alternatively, the diffuser may be a regular swirl diffuser having fixed vanes that extend radially from a central hub 1*b* that is substantially flush with the diffuser face. A perforated hub can be used to reduce smudging on a swirl diffuser that has a substantially flush face, especially if the hub is relatively large (as a proportion of the diffuser face). A larger hub can allow a more effective and thicker so-called air "screen" to be discharged, thereby better minimising smudging.

Swirling air stream 6 induces screen air stream 6' along the face of hub 1*b* in a direction substantially in the plane of diffuser face 1*a*, thereby creating an air screen of filtered and conditioned supply air that is low in moisture content and substantially free of dirt particles. Screen air stream 6' substantially prevents room air Ra from coming in contact with hub 1*b* and swirl vane trailing edges 7*a*', thereby reducing smudging and substantially eliminating condensation along these surfaces. This is especially advantageous in reducing smudging and condensation on diffusers 1 used in applications with high latent loads, such as zones with high infiltration in the tropics, and/or where room air tends to be contaminated, such as in applications with high infiltration (e.g. lobbies) close to roads with traffic (e.g. in a city).

FIG. 32*f* shows an alternative embodiment, in which guide vanes GV are located upstream of perforated portion P to guide screen air stream 6' along the face of hub 1*b* in a direction substantially in the plane of diffuser face 1*a*. While such an arrangement may appear to be advantageous so as to provide stable and effective screening of hub 1*b* and swirl vane trailing edges 7*a*', even when swirling air stream 6 is too weak to induce screen air stream 6' along these surfaces, this arrangement is, in fact, disadvantageous as zones of low pressure and turbulence are created directly downstream of guide vanes GV. These zones draw in room air Ra such that it comes into contact with portions of hub 1*a*, especially on the perforated portion P itself. In other words, spots of smudging and/or condensation may still occur with this embodiment, and may even be exacerbated by it.

Figure 33:
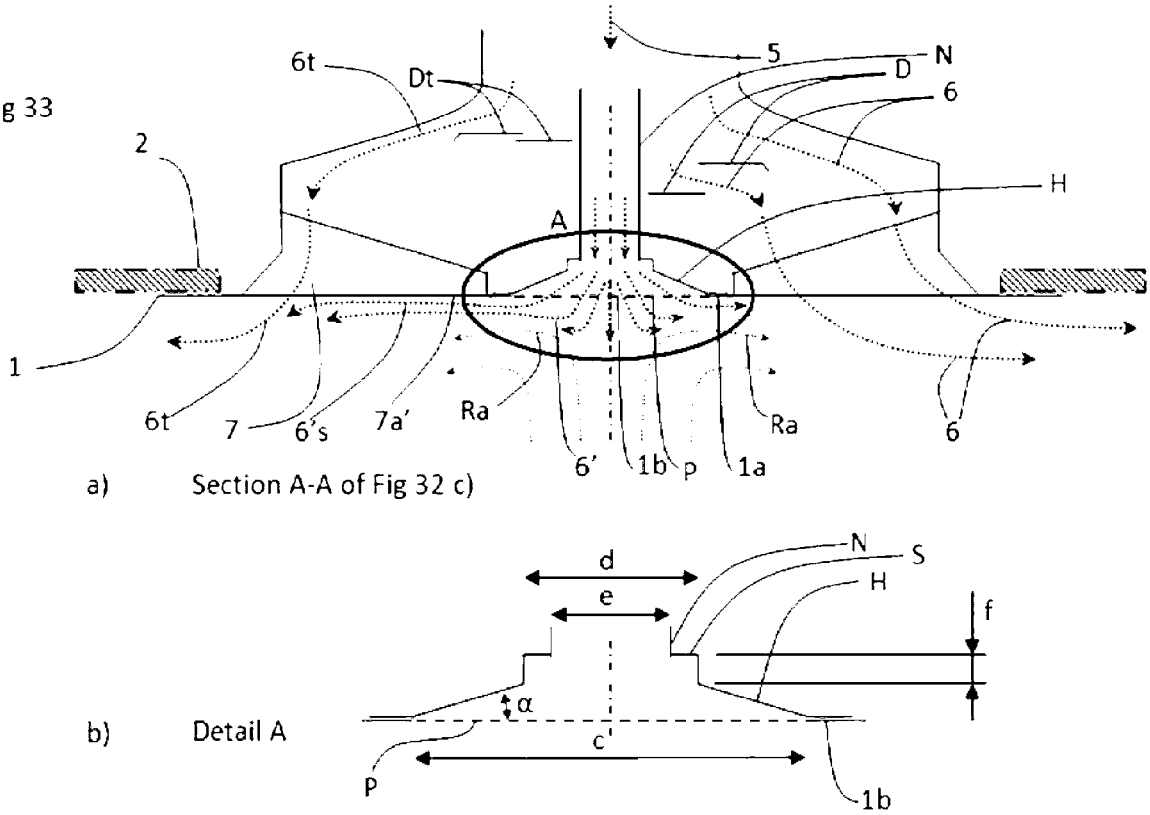
FIG. 33*a-b* show side sectional views of an embodiment of a swirl diffuser having a perforated central hub and an air guide arrangement.

FIGS. 33*a-b* show an embodiment in which a hood H is located upstream of perforated portion P in hub 1*b*, to guide screening air stream 6' to be discharged through perforated portion P in a direction that is substantially parallel to diffuser face 1*a*, without creating zones of low pressure that draw in room air Ra to be in contact with parts of perforated portion P or other parts of hub 1*b* or swirl vane trailing edges 7*a*'. Hood H is affixed to the rear of hub 1*b* to form acute angle (shown as angle α in FIG. 33*b*) with perforated portion P. Hood H may include a stepped inlet S within a neck N that may be extended to allow a damper arrangement Dt and D to throttle (damper positions represented as Dt on the left-hand side of FIG. 33*a*) or to unthrottle (damper positions represented as D on the right-hand side of FIG. 33*a*), respectively, supply air stream 5 onto swirl vanes 7, creating throttled swirl air stream 6*t* or unthrottled swirl air stream 6, respectively. Throttled air stream 6*t* may be too weak to effectively induce screen air stream 6' to flow along and hence screen the face of perforated portion P, other portions of hub 1*b* and swirl vane trailing edges 7*a*'. Hood H ensures effective and stable screening of these surfaces from smudging and condensation by screen air stream 6' even when swirl air stream 6*t* is too low to effectively induce screen air stream along these surfaces. To maximise stable discharge of screen air stream 6' along the face of hub 1*b*, the base of hood H may be in the form of a truncated cone of angle α, typically of less than 30°, angle α being defined between the wall of hood H and perforated portion P, with an angle α of approximately 10° being especially effective, and providing a maximum diameter of c in contact with and sealed to perforated portion P. It may be particularly advantageous to arrange the air inlet to hood H as a neck N of diameter e with step S of diameter d and height f such that the ratio of the step area (π multiplied by the square of (d divided by 2)) to the neck area (π multiplied by the square of (e divided by 2)) is approximately 1.3, and the ratio of the step area (π multiplied by the square of (d divided by 2)) to the maximum hood area (π multiplied by the square of (c divided by 2)) is approximately 0.5, with the ratio of step height f to maximum hood diameter c being approximately 0.15. In the absence of step S it is advantageous that the ratio of the neck area (π multiplied by the square of (e divided by 2)) to the maximum hood area (pi multiplied by the square of (c divided by 2)) is no more than 0.2, preferably less than or equal to 0.1.

It may also advantageous that perforated portion P has an open area (i.e. area open to airflow) of between about 10% and 25%, preferably between about 16% and 23%, with a hole diameter of between about 1.8 mm and 5 mm, and with a wall thickness of no more than about 1 mm, preferably no more than about 0.7 mm. The low perforated portion open area of between 10% and 25% may be advantageous for one or more of the following reasons:

1. The small diameter e of neck N relative to discharge diameter c of hood H in a plane parallel to perforated portion P acts to channel supply air 5 as a unidirectional air stream through neck N in a direction that is substantially perpendicular to perforated portion P and as a jet onto the central portion of perforated portion P. Due to its low open area (generally of between 10% and 25%) and small holes (generally of between 1.8 and 5 mm diameter) perforated portion P acts substantially as a baffle plate, causing most of the air jet that hits it as screen airstream 6' to be deflected sharply along the upstream surface of perforated portion P to spread peripherally, whilst only a small percentage of stream 6' penetrates at a relatively steep angle (i.e. substantially perpendicular to the plane of perforated portion P) through the central portion of perforated portion P and across a footprint area similar to that of neck N. In other words, most of screen airstream 6' is deflected strongly sideways by the substantially closed area of perforated portion P. The combination of this strong sideways deflection and the shallow angle α of hood H forces most of the screen airstream 6' to penetrate the remainder of perforated portion P at an extremely shallow angle (i.e. almost parallel to the plane of perforated portion P) so that the bulk of screen airstream 6' is discharged along the face of hub 1*b* in a direction substantially parallel to diffuser face 1*a*, thereby inducing the portion of screen airstream 6' discharged at a steep angle through the central portion of perforated portion P to also flow downstream of hub 1*b* in a direction substantially parallel to face 1*a*. As a result, screen airstream 6' is discharged through perforated portion P as a continuous "air cushion" that attaches to the downstream surface of hub 1*b* to spread peripherally in the plane of face 1*a*, thereby creating a continuous barrier of conditioned (i.e. clean and dry) air that screens the visible surfaces of perforated portion P, hub H and swirl vane trailing edges 7*a*' close to hub 1*b* from contact with moist and dirty room air Ra. This prevents, or at the very least reduces, the formation of condensation and/or smudging along these surfaces.

2. Even in the absence of hood H, the small open area (generally of between 10% and 25%) of perforated portion P in the centre of hub H is advantageous, as it ensures that screen airstream 6' only makes up an extremely small percentage (generally less than 3%) of the total airflow rate discharged by the diffuser (assuming that swirl air stream 6 has not been throttled to a reduced air stream 6*t*). This allows swirl air stream 6 discharged by swirl vanes 7 to dominate substantially, inducing screen airstream 6' discharged through perforated portion P to flow along the downstream surface of hub H in a direction substantially parallel to face 1*a*, creating a substantially continuous barrier of conditioned (i.e. clean and dry) air that substantially screens the visible surfaces of perforated portion P, hub H and swirl vane trailing edges 7*a*' close to hub 1*b* from contact with moist and dirty room air Ra.
3. The small open area (generally between about 10% and 25%) of perforation P in hub H is, furthermore, advantageous, because it ensures that the strong negative pressure zone created beneath hub 1*b* (refer to FIGS. 5 & 6) when the guide ring is lowered (FIGS. 8*b* & 8*d*) is not diminished, thereby preserving effective discharge directional control of swirl air stream 6 from substantially parallel 6*a*" & 6*c*' to face 1*a* when the guide ring is raised (FIGS. 8*a* & 8*c*), to substantially perpendicular discharge 6*b*' & 6*b*" to face 1*a* when the guide ring is lowered (FIGS. 8*b* & 8*d*).
4. A small perforated portion P open area is aesthetically preferable as it gives the appearance of being more closed than open (i.e. it almost appears solid). This is similar to perforated metal ceiling tiles, which usually have an open area of approximately 20% and a perforation size generally of 1.8 mm to 3 mm in diameter, and have a black fleece backing to provide acoustical absorption (this helps deaden the space so that the room doesn't sound too loud). A perforated portion P with a larger open area and/or larger perforation size is likely to look too dissimilar to the substantially "closed" look of typical perforated metal pan ceiling tiles and is, therefore, likely to be resisted by architects for aesthetic reasons.

In the claims which follow and in the preceding summary except where the context requires otherwise due to express language or necessary implication, the word "comprising" is used in the sense of "including", that is, the features as above may be associated with further features in various embodiments.

Variations and modifications may be made to the parts previously described without departing from the spirit or ambit of the disclosure.

The invention claimed is:

1. An air diffuser for supplying air to a space, the diffuser having a central axis and comprising:

a plurality of discharge elements arranged to guide an air stream towards a space, the plurality of discharge elements having respective edge regions that define a face of the diffuser;

wherein a plurality of channels are located about the diffuser central axis, each channel being formed between adjacent pairs of discharge elements and configured to guide the air to the space;

an adjustment mechanism able to translate along the central axis between an advanced position, wherein the adjustment mechanism is positioned towards the diffuser face, and a retracted position, wherein the adjustment mechanism is positioned away from the diffuser face; and a plurality of substantially radially aligned guide vanes, each guide vane connected to and projecting from a wall of the adjustment mechanism, wherein an underside surface of each guide vane is shaped such that the underside surface remains substantially in contact with a leading edge of its respective discharge element along a translation path of the adjustment mechanism between the retracted position and the advanced position.

2. The air diffuser according to claim 1, wherein the plurality of discharge elements are substantially radially aligned about the central axis of the diffuser, the central axis being substantially perpendicular to the diffuser face, and each discharge element comprises a peripheral portion and a proximal portion relative to the central axis, wherein the peripheral portion has a first air guide surface arranged to guide a peripheral air stream in a first direction that is substantially perpendicular to the diffuser face, and the proximal portion has a second air guide surface arranged to guide a proximal air stream in a second direction, the first and second directions forming an acute angle therebetween.

3. The air diffuser according to claim 1 wherein the adjustment mechanism is able to translate along the central axis between the retracted position, wherein the adjustment mechanism is positioned adjacent to the channels such that the channels are unobstructed by the adjustment mechanism, and the advanced position, wherein the adjustment mechanism is positioned towards the diffuser face such that it obstructs the channels.

4. The air diffuser according to claim 1, wherein when the adjustment mechanism is in the retracted position, the air stream is supplied to the space in a direction that is substantially parallel with a plane of the diffuser face, and when the adjustment mechanism is in the advanced position, the air stream is supplied in a direction that is substantially perpendicular to the plane of the diffuser face.

5. The air diffuser according to claim 4, wherein when the adjustment mechanism is between the retracted and advanced positions, the air stream is supplied to the space in a direction that is somewhere between substantially parallel with the plane of the diffuser face and substantially perpendicular with the plane of the diffuser face.

6. The air diffuser according to claim 1, wherein each guide vane is associated with a discharge element to form a diffuser blade and, when the adjustment mechanism is in the retracted position, each guide vane is positioned such that it forms an extension of its respective discharge element to define a first guidance width of the diffuser blade.

7. The air diffuser according to claim 6, wherein when the adjustment mechanism is in the advanced position, each guide vane is positioned over its respective discharge element to define a second guidance width of the diffuser blade, wherein the second guidance width is less than the first guidance width.

8. The air diffuser of claim 1 wherein:

the plurality of discharge elements are substantially radially aligned about the central axis of the diffuser, the central axis being substantially perpendicular to the diffuser face and each discharge element having a proximal end that is connected to a central hub located at the central axis of the diffuser; and the central hub being formed as a perforated hub, the perforated central hub comprising a plurality of apertures formed therethrough, wherein each aperture is configured to discharge a portion of the supply air stream to the space.

9. An air diffuser for supplying air to a space, the diffuser having a central axis comprising:

a plurality of discharge elements arranged to guide an air stream towards a space, the plurality of discharge elements having respective edge regions that define a face of the diffuser;

wherein a plurality of channels are located about the diffuser central axis, each channel being formed between adjacent pairs of discharge elements and configured to guide the air to the space;

an adjustment mechanism able to translate along the central axis between an advanced position, wherein the adjustment mechanism is positioned towards the diffuser face, and a retracted position, wherein the adjustment mechanism is positioned away from the diffuser face;

a plurality of substantially radially aligned guide vanes, each guide vane connected to and projecting from a wall of the adjustment mechanism;

a housing for supporting the plurality of discharge elements, the housing comprising a plate coplanar with the diffuser face and a neck portion extending from the plate for connecting the diffuser to an air source;

wherein the adjustment mechanism comprises a guide ring configured to translate and rotate within the neck portion of the housing and a plurality of slots are formed in the wall of the guide ring, each of the slots being configured to receive a respective discharge element upon translation and rotation of the adjustment mechanism from the retracted position towards the advanced position, and each of the slots configured to release its respective discharge element upon translation and rotation of the adjustment mechanism from the advanced position towards the retracted position.

10. The air diffuser according to claim 9, wherein each of the plurality of discharge elements has opposing ends that abut, or are fastened to, or are integrally formed with, respectively, a central portion of the plate and the neck portion of the housing.

11. The air diffuser according to claim 10, wherein each discharge element abuts the neck portion of the housing, the neck portion being substantially circular about the central axis and located upstream of the diffuser face, and wherein the neck portion is configured to flare towards the diffuser face.

12. The diffuser according to claim 9, wherein the plurality of guide vanes are connected to and project away from a wall of the guide ring.

13. The air diffuser for supplying air to a space according to claim 9 wherein:

at least one of the discharge elements comprises a peripheral portion and a proximal portion relative to the central axis, wherein the peripheral portion has a first air guide surface arranged to guide a peripheral air stream in a first direction that is substantially perpendicular to the diffuser face, and the proximal portion has a second air guide surface arranged to guide a proximal air stream in a second direction, the first and second directions forming an acute angle therebetween.

14. An air diffuser for supplying air to a space, the diffuser having a central axis and comprising:

a plurality of discharge elements arranged to guide an air stream towards a space, the plurality of discharge elements having respective edge regions that define a face of the diffuser;

wherein a plurality of channels are located about the diffuser central axis, each channel being formed between adjacent pairs of discharge elements and configured to guide the air to the space;

an adjustment mechanism able to translate along the central axis between an advanced position, wherein the adjustment mechanism is positioned towards the diffuser face, and a retracted position, wherein the adjustment mechanism is positioned away from the diffuser face; and a plurality of substantially radially aligned guide vanes, each guide vane connected to and projecting from a wall of the adjustment mechanism;

wherein the adjustment mechanism comprises:

a guide ring configured to translate and rotate relative to a housing of the diffuser configured to support the plurality of discharge elements; and a plurality of substantially radially aligned guide vanes, each guide vane connected to and projecting away from an internal wall of the guide ring; and wherein a plurality of slots are formed in the wall of the guide ring, each of the slots configured to receive a respective discharge element of the diffuser upon translation and rotation of the adjustment mechanism from a retracted position towards an advanced position, and to release its respective discharge element upon translation and rotation of the adjustment mechanism from the advanced position towards the retracted position.

15. The air diffuser according to claim 14, wherein at least one of the plurality of guide vanes includes a geometric twist about a substantially radial axis of the guide ring.

16. The air diffuser according to claim 15, wherein the geometric twist comprises a substantially constant helical pitch such that each point on the guide vane traverses an equal helical pitch distance parallel to a central axis of the guide ring for a given angle of rotation about the central axis.

* * * * *